US007808431B2

(12) United States Patent
Shibuya et al.

(10) Patent No.: US 7,808,431 B2
(45) Date of Patent: Oct. 5, 2010

(54) ANTENNA APPARATUS CAPABLE OF DIRECTIVITY CONTROL

(75) Inventors: Eiji Shibuya, Kobe (JP); Toshio Fujita, Kobe (JP)

(73) Assignee: DX Antenna Company, Limited, Kobe-Shi (JP)

( * ) Notice: Subject to any disclaimer, the term of this patent is extended or adjusted under 35 U.S.C. 154(b) by 276 days.

(21) Appl. No.: 12/005,271

(22) Filed: Dec. 27, 2007

(65) Prior Publication Data

US 2008/0252523 A1 Oct. 16, 2008

(30) Foreign Application Priority Data

Dec. 28, 2006 (JP) ..... 2006-355577

(51) Int. Cl.
*H01Q 3/24* (2006.01)
*H01Q 3/26* (2006.01)

(52) U.S. Cl. ..... 342/374; 343/876

(58) Field of Classification Search ..... 342/368, 342/374; 343/700 MS, 797, 853, 876
See application file for complete search history.

(56) References Cited

U.S. PATENT DOCUMENTS 4,123,759 A * 10/1978 Hines et al. ..... 342/374
4,334,230 A * 6/1982 Kane ..... 343/797
6,914,558 B1 * 7/2005 Shirosaka et al. ..... 342/371
7,432,857 B2 * 10/2008 Yamamoto et al. ..... 342/374
7,612,715 B2 * 11/2009 Macleod ..... 342/432
2002/0036586 A1 * 3/2002 Gothard et al. ..... 342/374
2007/0063909 A1 3/2007 Fujita et al.

FOREIGN PATENT DOCUMENTS

GB 2152759 A * 8/1985
JP 2006-157209 A 6/2006

* cited by examiner

*Primary Examiner*—Thomas H Tarcza
*Assistant Examiner*—Cassi Galt
(74) *Attorney, Agent, or Firm*—Birch, Stewart Kolasch & Birch, LLP

(57) ABSTRACT

The antenna apparatus includes first to fourth antenna elements successively arranged at regular angular intervals around the central point on the same plane and respectively having first to fourth feed points, and a phase shifter delaying the phase of the received electric wave approximately by 90 degrees. The unidirectivity of the antenna apparatus is controlled in four directions of 0 degree, 90 degrees, 180 degrees and 270 degrees by selectively connecting the first to fourth feed points, the phase shifter and a television receiver. Therefore, multipath interference in these directions can be suppressed.

8 Claims, 22 Drawing Sheets

FIG.22

| BEAM DIRECTION | SW1 | SW2 | SW3 | SW4 | SW5 | SW6 | SW7 | UNIDIRECTIVITY | 8-SHAPED DIRECTIVITY |
|---|---|---|---|---|---|---|---|---|---|
| 0° DIRECTION | A1 | A2 | A3 | A4 | B5 | B6 | A7 | | — |
| 45° DIRECTION | B1 | B2 | B3 | B4 | D5 | D6 | E7 | — | |
| 90° DIRECTION | B1 | B2 | B3 | B4 | B5 | B6 | A7 | | — |
| 135° DIRECTION | A1 | A2 | A3 | A4 | D5 | D6 | E7 | — | |
| 180° DIRECTION | A1 | A2 | A3 | A4 | B5 | B6 | B7 | | — |
| 225° DIRECTION | B1 | B2 | B3 | B4 | D5 | D6 | E7 | — | |
| 270° DIRECTION | B1 | B2 | B3 | B4 | B5 | B6 | B7 | | — |
| 315° DIRECTION | A1 | A2 | A3 | A4 | D5 | D6 | E7 | — | |

470MHz

509MHz

581MHz

653MHz

725MHz

806MHz

ANTENNA APPARATUS CAPABLE OF DIRECTIVITY CONTROL

This nonprovisional application is based on Japanese Patent Application No. 2006-355577 filed with the Japan Patent Office on Dec. 28, 2006, the entire contents of which are hereby incorporated by reference.

BACKGROUND OF THE INVENTION

1. Field of the Invention

The present invention relates to an antenna apparatus, and more particularly to an antenna apparatus capable of directivity control.

2. Description of the Background Art

FIG. 23 is a plan view showing a main part of a conventional antenna apparatus capable of directivity control. In FIG. 23, this antenna apparatus includes four antenna elements 51-54 successively arranged at regular angular intervals around the central point on the same plane. Antenna elements 51-54 respectively have feed points P1-P4. Antenna elements 51 and 53 and antenna elements 52 and 54 respectively form dipole antennas. The antenna apparatus is used to receive electric waves for a plurality of UHF (Ultra High Frequency) television broadcastings. Antenna elements 51-54 are arranged horizontally, and for example, antenna element 52 is oriented in the direction of a main UHF television broadcast station. It is assumed that the direction of antenna element 52 is 0 degree as viewed from the central point. The directivity of the antenna apparatus is controlled in the direction of the UHF television broadcast station selected from a plurality of UHF television broadcast stations by a viewer.

FIGS. 24A-24D are diagrams showing a directivity control method of this antenna apparatus. As shown in FIG. 24A, when the 8-shaped directivity of the antenna apparatus is oriented in the 0 degree direction (forward) and the 180 degree direction (backward), feed points P1, P3 are connected to a television receiver. An electric wave transmitted from the 0 degree direction is received by antenna elements 51, 53 and applied to the television receiver through feed points P1, P3. On the other hand, an electric wave transmitted from the 180 degree direction is received by antenna elements 51, 53 and applied to the television receiver through feed points P1, P3. Therefore, the directivity of the antenna apparatus is 8-shaped directivity in which reception sensitivity is maximum in the 0 degree direction and the 180 degree direction, as shown by a dotted line in FIG. 24A.

Furthermore, as shown in FIG. 24B, when the 8-shaped directivity of the antenna apparatus is oriented in the 90 degree direction (horizontal right direction) and the 270 degree direction (horizontal left direction), feed points P2, P4 are connected to the television receiver. An electric wave transmitted from the 90 degree direction is received by antenna elements 52, 54 and applied to the television receiver through feed points P2, P4. On the other hand, an electric wave transmitted from the 270 degree direction is received by antenna elements 52, 54 and applied to the television receiver through feed points P2, P4. Therefore, the directivity of the antenna apparatus is 8-shaped directivity in which reception sensitivity is maximum in the 90 degree direction and the 270 degree direction, as shown by a dotted line in FIG. 24B.

Furthermore, as shown in FIG. 24C, when the 8-shaped directivity of the antenna apparatus is oriented in the 45 degree direction (diagonally forward right direction) and the 225 degree direction (diagonally backward left direction), transmission lines 55, 56 are respectively connected between feed points P1 and P2 and between feed points P3 and P4, and feed points P1, P4 are connected to the television receiver. Thus, antenna elements 51 and 52 form one antenna element while antenna elements 53 and 54 form another antenna element, and the formed two antenna elements receive electric waves from the 45 degree direction and the 225 degree direction. Therefore, the directivity of the antenna apparatus is 8-shaped directivity in which reception sensitivity is maximum in the 45 degree direction and the 225 degree direction, as shown by a dotted line in FIG. 24C.

In addition, as shown in FIG. 24D, when the 8-shaped directivity of the antenna apparatus is oriented in the 135 degree direction (diagonally backward right direction) and the 315 degree direction (diagonally forward left direction), transmission lines 55, 56 are respectively connected between feed points P1 and P4 and between feed points P2 and P3, and feed points P1, P2 are connected to the television receiver. Thus, antenna elements 51 and 54 form one antenna element while antenna elements 52 and 53 form another antenna element, and the formed two antenna elements receive electric waves from the 135 degree direction and the 315 degree direction. Therefore, the directivity of the antenna apparatus is 8-shaped directivity in which reception sensitivity is maximum in the 135 degree direction and the 315 degree direction, as shown by a dotted line in FIG. 24D.

FIG. 25 is a diagram showing the frequency characteristic of the gain of this antenna apparatus. In FIG. 25, the range of frequency is 470-806 MHz, which range includes the frequency ranges of UHF television broadcasting in Japan and the United States. In Japan, the frequency range of broadcasting electric waves in UHF television broadcasting is 470-770 MHz (13-62 channels). In particular, in the case of terrestrial digital broadcasting, the frequency range is 470-710 MHz. On the other hand, in the case of UHF television broadcasting in the United States, the frequency range is 470-806 MHz. As can be understood from FIG. 25, this antenna apparatus has sufficiently high gain in 470-806 MHz.

FIGS. 26A-26F are diagrams showing the frequency characteristics of 8-shaped directivity in the 0 degree direction of this antenna apparatus. As can be understood from FIGS. 26A-26F, this antenna apparatus has good 8-shaped directivity in 470-806 MHz.

There also exists an antenna apparatus which realizes 8-shaped directivity in four directions by combining the directivity of two dipole antennas arranged orthogonal to each other (see, for example, Japanese Patent Laying-Open No. 2006-157209).

The conventional antenna apparatus is, however, susceptible to multipath interference since it has 8-shaped directivity. For example, since the reception sensitivity for electric waves from the front and the reception sensitivity for electric waves from the back are the same, if a building stands at the back of the antenna apparatus, the electric wave from the front and the electric wave reflected on the building at the back are combined, resulting in unclear images.

SUMMARY OF THE INVENTION

Therefore, a main object of the present invention is to provide an antenna apparatus capable of directivity control and less susceptible to multipath interference.

An antenna apparatus in accordance with the present invention is capable of directivity control. The antenna apparatus includes: first to fourth antenna elements successively arranged at regular angular intervals around a central point on a same plane and respectively having first to fourth feed points; a phase shifter delaying a phase of a received electric wave approximately by 90 degrees; and first switching circuit, controlling a direction of unidirectivity of the antenna apparatus. The first switching circuit connects the phase shifter between the first and second feed points and the third and fourth feed points, in a first case in which the unidirectivity is controlled in a direction between the first and second antenna elements, connects the phase shifter between the second and third feed points and the fourth and first feed points, in a second case in which the unidirectivity is controlled in a direction between the second and third antenna elements, connects the phase shifter between the third and fourth feed points and the first and second feed points, in a third case in which the unidirectivity is controlled in a direction between the third and fourth antenna elements, and connects the phase shifter between the fourth and first feed points and the second and third feed points, in a fourth case in which the unidirectivity is controlled in a direction between the fourth and first antenna elements.

Therefore, the unidirectivity can be controlled in four directions. In addition, multipath interference is less likely because of the unidirectivity, for example, since the reception sensitivity for an electric wave from the front is higher than the reception sensitivity for an electric wave from the back.

Preferably, the first switching circuit combines an electric wave received by the first and second antenna elements and delayed by the phase shifter with an electric wave received by the fourth and third antenna elements for application to a receiver apparatus, in the first case, combines an electric wave received by the second and third antenna elements and delayed by the phase shifter with an electric wave received by the first and fourth antenna elements for application to the receiver apparatus, in the second case, combines an electric wave received by the third and fourth antenna elements and delayed by the phase shifter with an electric wave received by the second and first antenna elements for application to the receiver apparatus, in the third case, and combines an electric wave received by the fourth and first antenna elements and delayed by the phase shifter with an electric wave received by the third and second antenna elements for application to the receiver apparatus, in the fourth case.

Preferably, the first switching circuit combines an electric wave received by the first and second antenna elements with an electric wave received by the third and fourth antenna elements and delayed by the phase shifter for application to a receiver apparatus, in the first case, combines an electric wave received by the second and third antenna elements with an electric wave received by the fourth and first antenna elements and delayed by the phase shifter for application to the receiver apparatus, in the second case, combines an electric wave received by the third and fourth antenna elements with an electric wave received by the first and second antenna elements and delayed by the phase shifter for application to the receiver apparatus, in the third case, and combines an electric wave received by the fourth and first antenna elements with an electric wave received by the second and third antenna elements and delayed by the phase shifter for application to the receiver apparatus, in the fourth case.

Preferably, the antenna apparatus further includes second switching circuit controlling a direction of 8-shaped directivity of the antenna apparatus. The second switching circuit applies an electric wave received by the second and fourth antenna elements to the receiver apparatus, in a fifth case in which the 8-shaped directivity is controlled in directions of the first and third antenna elements, and applies an electric wave received by the first and third antenna elements to the receiver apparatus, in a sixth case in which the 8-shaped directivity is controlled in directions of the second and fourth antenna elements.

Preferably, the first and third antenna elements form a first dipole antenna, and the second and fourth antenna elements form a second dipole antenna.

Preferably, each of the first and second dipole antennas is a fan dipole antenna.

Preferably, the first and second dipole antennas are formed of a conductive film provided on an insulating substrate or an insulating film.

Preferably, the first and third antenna elements form a first loop antenna, and the second and fourth antenna elements form a second loop antenna.

Preferably, each of the first and second loop antennas is a half-wavelength folded dipole antenna.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 22 is a diagram showing the relation between conduction terminals of switches shown in FIG. 21 and the directivity of the antenna apparatus.

DESCRIPTION OF THE PREFERRED EMBODIMENTS

First Embodiment

Figure 1:
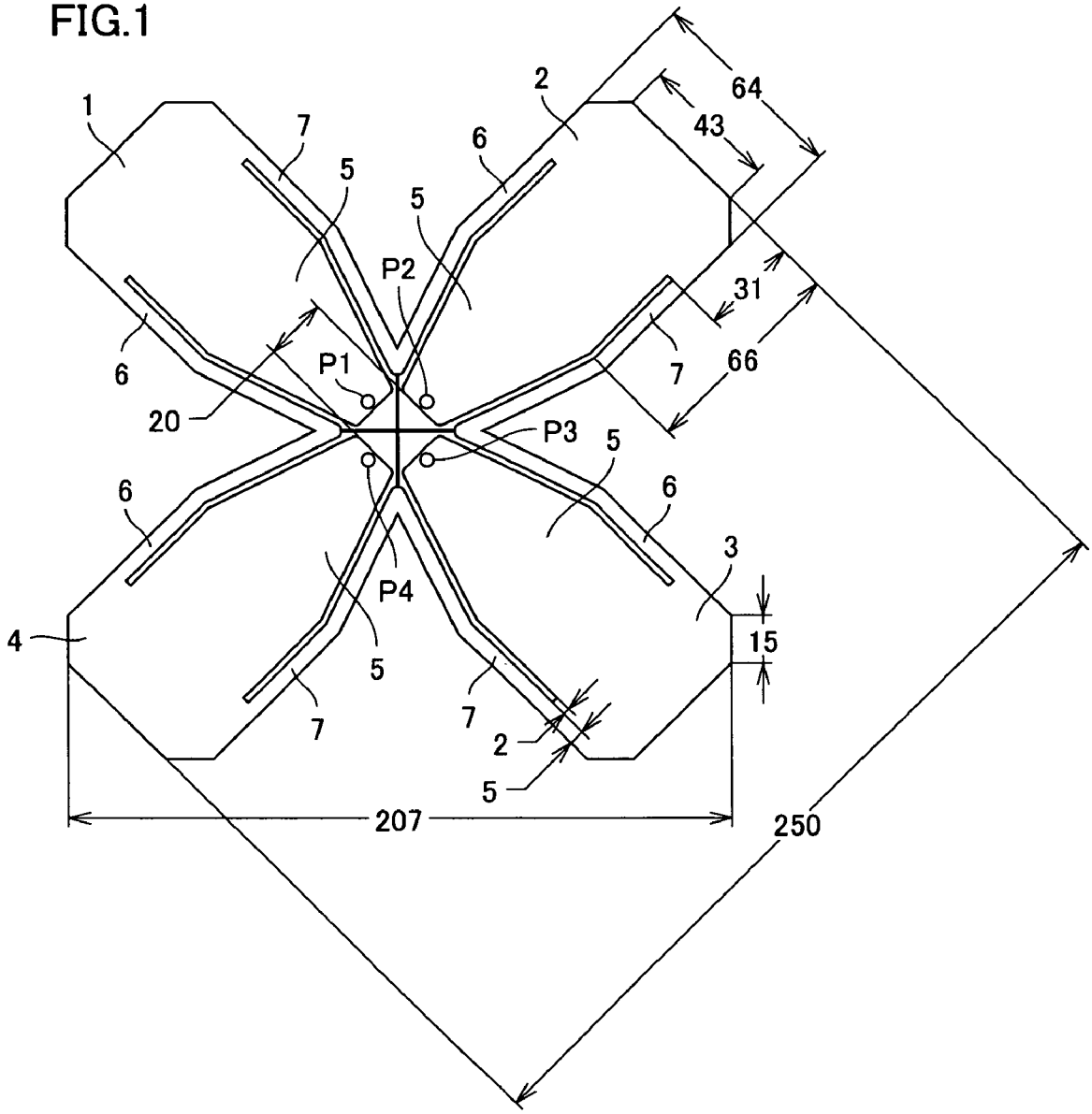
FIG. 1 is a plan view showing a main part of an antenna apparatus in accordance with a first embodiment of the present invention.

FIG. 1 is a plan view showing a main part of an antenna apparatus in accordance with a first embodiment of the present invention. In FIG. 1, this antenna apparatus includes four antenna elements 1-4 successively arranged at regular angular intervals around the central point on the same plane. Antenna elements 1-4 respectively have feed points P1-P4. Antenna elements 1 and 3 and antenna elements 2 and 4 respectively form dipole antennas.

Each of antenna elements 1-4 includes a fan-shaped dipole element 5 and transmission line portions 6, 7. Feed points P1-P4 are provided at the respective base end portions (the portions closer to the central point) of dipole elements 5 of antenna elements 1-4. Transmission line portions 6, 7 are provided along opposite two sides of dipole element 5. One ends of transmission line portions 6, 7 are connected to the tip end portion (the portion opposite to the central point) of dipole element 5. The other end of each transmission line portion 6 is connected to the other end of transmission line portion 7 of the adjacent antenna element and also connected to the opposing transmission line portions 6, 7. Provision of transmission line portions 6, 7 improves the characteristics and reduces the size of the antenna apparatus (see, for example, Japanese Patent Laying-Open No. 2006-157209).

The length from the tip end of antenna element 1 to the tip end of antenna element 3 and the length from the tip end of antenna element 2 to the tip end of antenna element 4 are both 250 mm. The distance between the base end of antenna element 1 and the base end of antenna element 3 and the distance between the base end of antenna element 2 and the base end of antenna element 4 are both 20 mm. The width of each of antenna elements 1-4 gradually increases from the base end to the tip end and is 64 mm at a distance of 66 mm from the tip end. A gap of 2 mm is provided each between dipole element 5 and transmission line portions 6, 7.

The antenna apparatus is used to receive electric waves for a plurality of UHF television broadcastings. Antenna elements 1-4 are arranged horizontally and the direction intermediate between antenna elements 1 and 2 is oriented in the direction of a main UHF television broadcast station. It is assumed that the direction intermediate between antenna elements 1 and 2 is 0 degree as viewed from the central point. The directivity of the antenna apparatus is controlled to the direction of the UHF television broadcast station selected from a plurality of UHF television broadcast stations by a viewer.

Figure 2A:
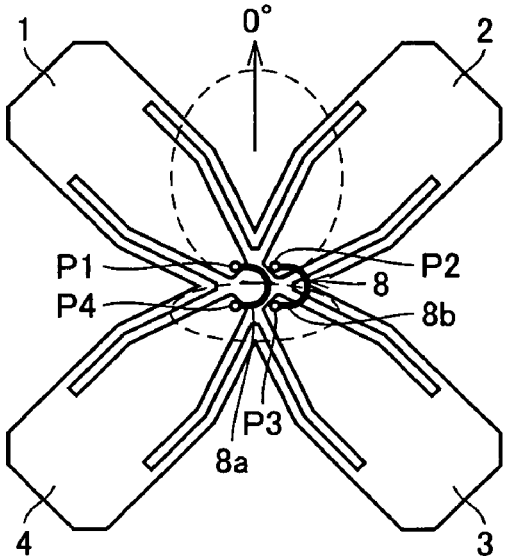
FIGS. 2A-2D are diagrams showing a directivity control method of the antenna apparatus shown in FIG. 1.

FIGS. 2A-2D are diagrams showing a directivity control method of this antenna apparatus. As shown in FIG. 2A, when the unidirectivity of the antenna apparatus is oriented in the 0 degree direction, a phase shifter 8 is connected between feed points P1, P2 and feed points P4, P3 and, in addition, feed points P4, P3 are connected to a television receiver. Phase shifter 8 delays the phase of the received electric wave approximately by 90 degrees. Phase shifter 8 is formed of, for example, parallel lines including two transmission lines 8*a*, 8*b* arranged in parallel, with a length of 160 mm and with the characteristic impedance of 300 ohms. An electric wave from the 0 degree direction is received by antenna elements 1, 2, delayed approximately by 90 degrees by phase shifter 8, and transmitted to feed points P4, P3. Furthermore, an electric wave from the 0 degree direction is delayed approximately by 90 degrees in space and received by antenna elements 4, 3. Therefore, the electric wave received by antenna elements 1, 2 and delayed by phase shifter 8 and the electric wave received by antenna elements 4, 3 have the same phase and are combined at feed points P4, P3.

On the other hand, an electric wave from the 180 degree direction is received by antenna elements 4, 3 and applied to feed points P4, P3. Furthermore, an electric wave from the 180 degree direction is delayed approximately by 90 degrees in space and then received by antenna elements 1, 2 and further delayed approximately by 90 degrees by phase shifter 8 to be transmitted to feed points P4, P3. Therefore, the electric wave received by antenna elements 1, 2 and delayed by phase shifter 8 and the electric wave received by antenna elements 4, 3 have the opposite phase, and the electric waves attenuate. In this case, the directivity of the antenna apparatus is unidirectional with the reception sensitivity in the 0 degree direction higher than the reception sensitivity in the 180 degree direction, as shown in a dotted line in FIG. 2A.

On the other hand, when the unidirectivity of the antenna apparatus is oriented in the 180 degree direction, similarly to FIG. 2A, phase shifter 8 is connected between feed points P1, P2 and feed points P4, P3 and feed points P1, P2 are connected to the television receiver, in place of feed points P4, P3. In this case, the directivity of the antenna apparatus is opposite to the case in FIG. 2A and is unidirectional with the reception sensitivity in the 180 degree direction higher than the reception sensitivity in the 0 degree direction.

Figure 2B:
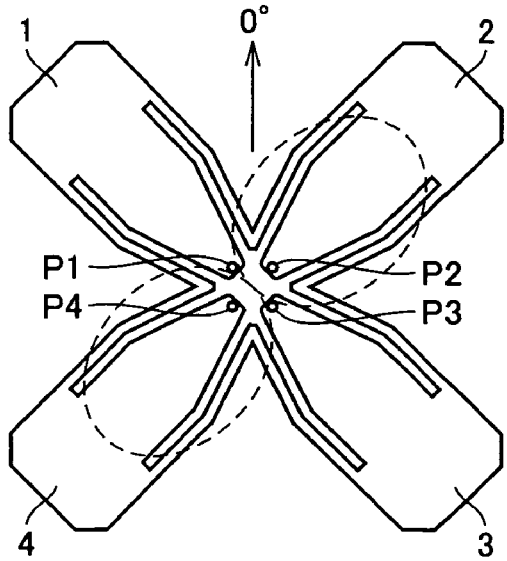

Furthermore, as shown in FIG. 2B, when the 8-shaped directivity of the antenna apparatus is oriented in the 45 degree and 225 degree direction, feed points P1, P3 are connected to the television receiver. An electric wave transmitted from the 45 degree direction is received by antenna elements 1, 3 and applied to the television receiver through feed points P1, P3. On the other hand, an electric wave transmitted from the 225 degree direction is received by antenna elements 1, 3 and applied to the television receiver through feed points P1, P3. In this case, the directivity of the antenna apparatus is 8-shaped directivity in which the reception sensitivity is maximum in the 45 degree direction and the 225 degree direction, as shown by a dotted line in FIG. 2B.

Figure 2C:
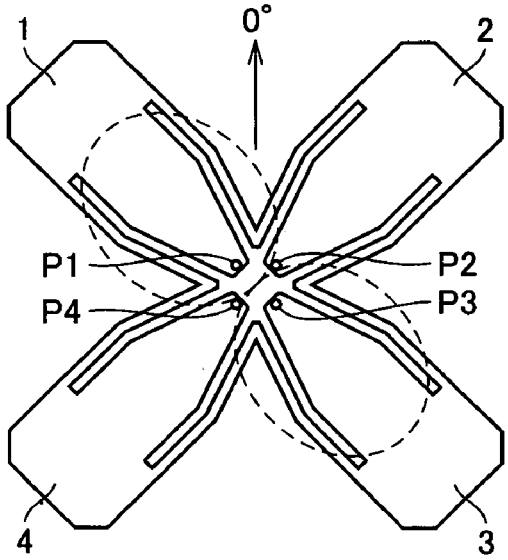

Furthermore, as shown in FIG. 2C, when the 8-shaped directivity of the antenna apparatus is oriented in the 135 degree and 315 degree direction, feed points P2, P4 are connected to the television receiver. An electric wave transmitted from the 135 degree direction is received by antenna elements 2, 4 and applied to the television receiver through feed points P2, P4. On the other hand, an electric wave transmitted from the 315 degree direction is received by antenna elements 2, 4 and applied to the television receiver through feed points P2, P4. In this case, the directivity of the antenna apparatus is 8-shaped directivity in which the reception sensitivity is maximum in the 135 degree direction and the 315 degree direction, as shown by a dotted line in FIG. 2C.

Figure 2D:
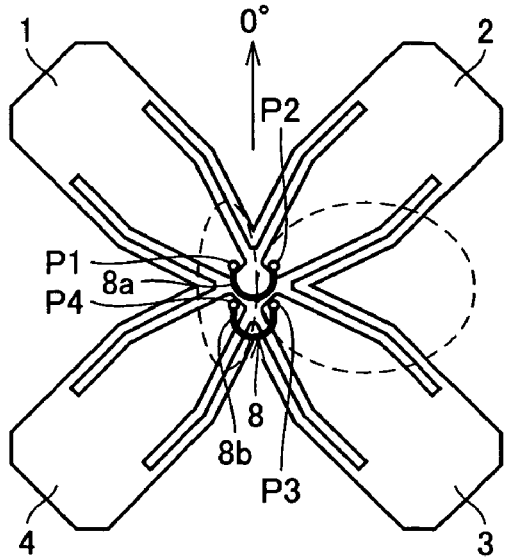

In addition, as shown in FIG. 2D, when the unidirectivity of the antenna apparatus is oriented in the 90 degree direction, phase shifter 8 is connected between feed points P2, P3 and feed points P1, P4, and in addition, feed points P1, P4 are connected to the television receiver. An electric wave from the 90 degree direction is received by antenna elements 2, 3, delayed approximately by 90 degrees by phase shifter 8 and then transmitted to feed points P1, P4. Furthermore, an electric wave from the 90 degree direction is delayed approximately by 90 degrees in space and received by antenna elements 1, 4. Therefore, the electric wave received by antenna elements 2, 3 and delayed by phase shifter 8 and the electric wave received by antenna elements 1, 4 have the same phase and combined at feed points P1, P4.

On the other hand, an electric wave from the 270 degree direction is received by antenna elements 1, 4 and applied to feed points P1, P4. Furthermore, an electric wave from the 270 degree direction is delayed approximately by 90 degrees in space, then received by antenna elements 2, 3, and further delayed approximately by 90 degrees by phase shifter 8 to be transmitted to feed points P1, P4. Therefore, the electric wave received by antenna elements 2, 3 and delayed by phase shifter 8 and the electric wave received by antenna elements 1, 4 have the opposite phase, and the electric waves attenuate. In this case, the directivity of the antenna apparatus is unidirectional with the reception sensitivity in the 90 degree direction higher than the reception sensitivity in the 270 degree direction, as shown in a dotted line in FIG. 2D.

When the unidirectivity of the antenna apparatus is oriented in the 270 degree direction, similarly to FIG. 2D, phase shifter 8 is connected between feed points P2, P3 and feed points P1, P4, and feed points P3, P2 are connected to the television receiver, in place of feed points P1, P4. In this case, the directivity of the antenna apparatus is opposite to the case in FIG. 2D and is unidirectional with the reception sensitivity in the 270 degree direction higher than the reception sensitivity in the 90 degree direction.

Figure 3:
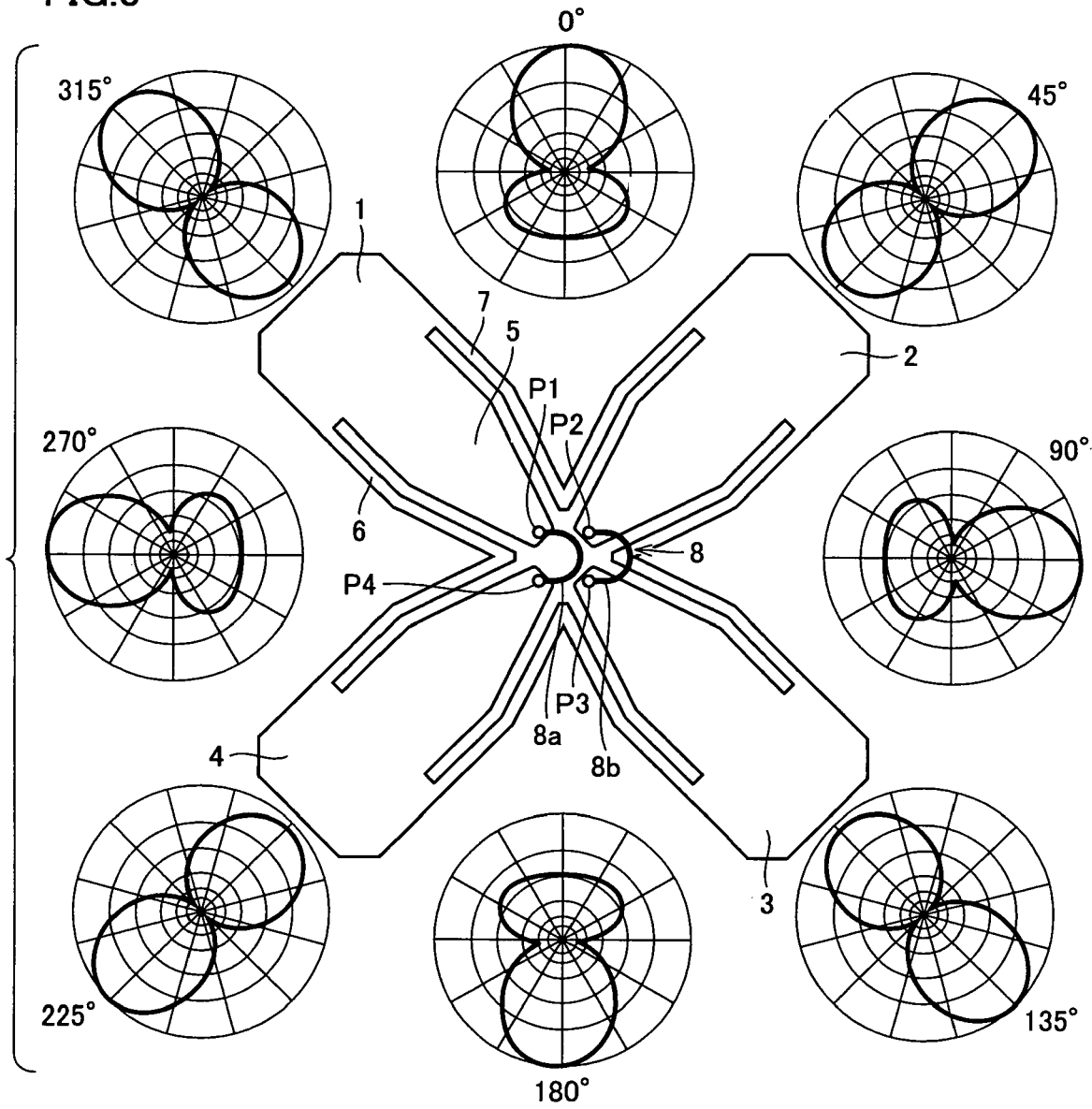
FIG. 3 is a diagram showing the directivity in eight directions of the antenna apparatus shown in FIG. 1.

Therefore, according to this antenna apparatus, as shown in FIG. 3, the unidirectivity can be controlled in four directions, namely, 0 degree, 90 degrees, 180 degrees and 270 degrees. In addition, the 8-shaped directivity can be controlled in two directions, namely, 45 degrees and 225 degrees, and 135 degrees and 315 degrees.

It is noted that in FIGS. 2A-2D, for the sake of brevity of the drawings, it is not shown that the opposing transmission line portions 6, 7 are connected to each other in the central portion of antenna elements 1-4. This also applies to the drawings illustrated below.

Figure 4:
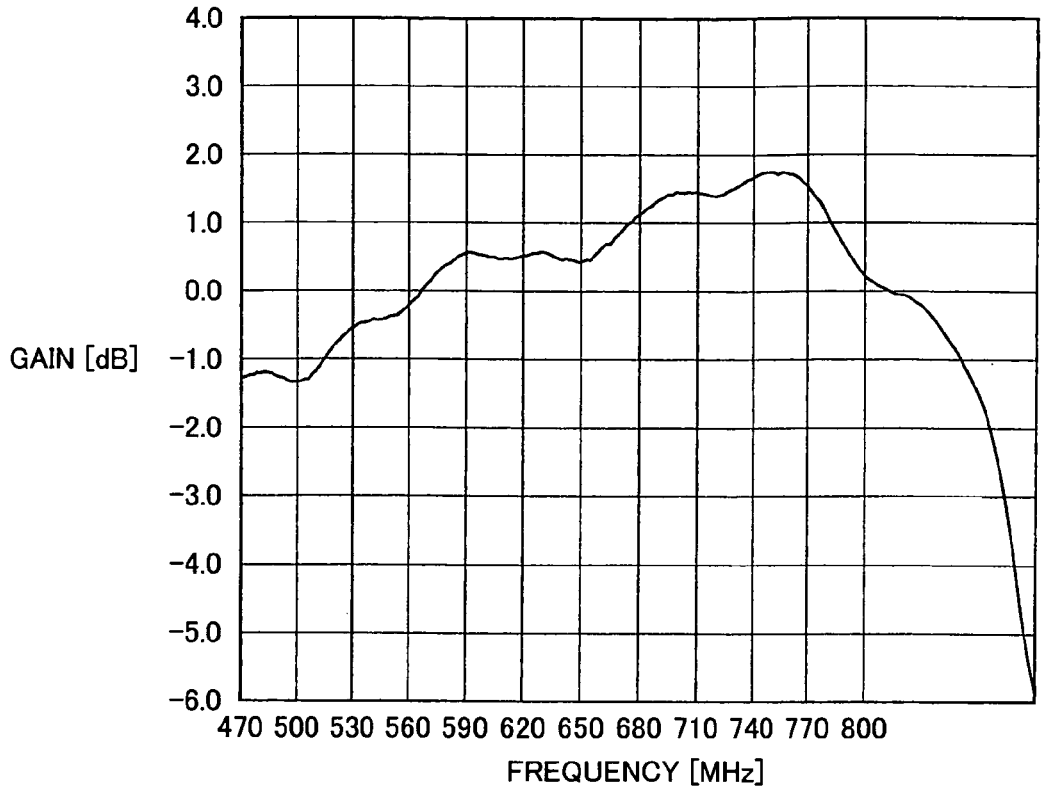
FIG. 4 is a diagram showing a frequency characteristic of gain of the antenna apparatus shown in FIGS. 1-3.
Figure 5:
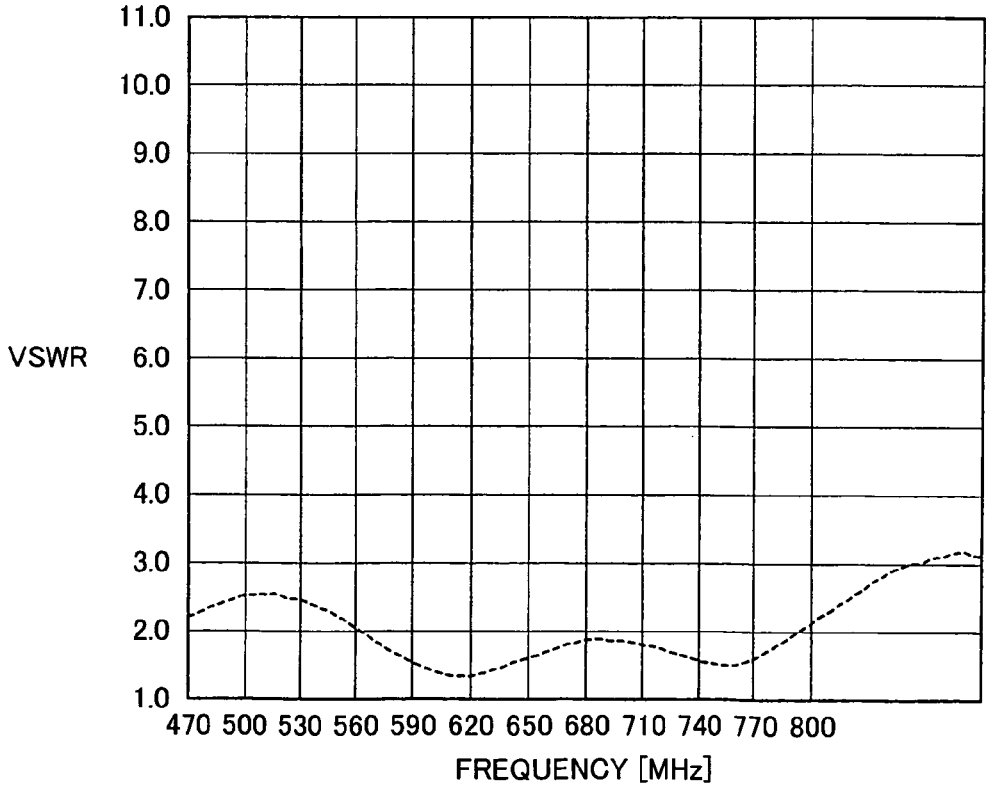
FIG. 5 is a diagram showing a frequency characteristic of VSWR of the antenna apparatus shown in FIGS. 1-3.
Figure 6A:
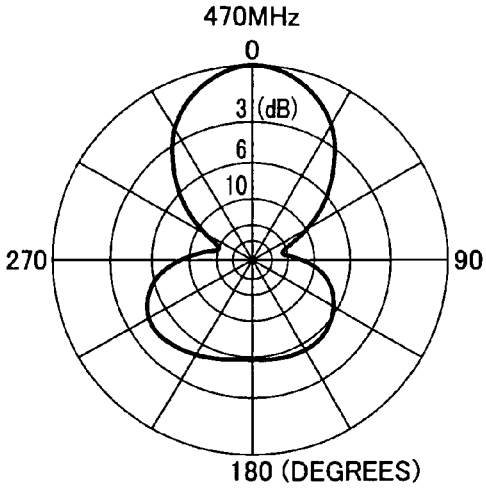
FIGS. 6A-6F are diagrams showing a frequency characteristic of unidirectivity of the antenna apparatus shown in FIGS. 1-3.
Figure 6B:
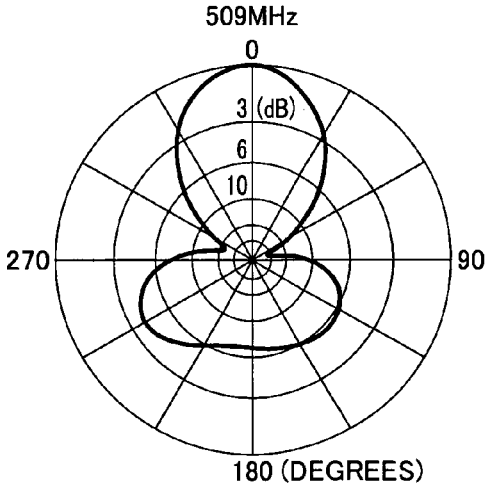
Figure 6C:
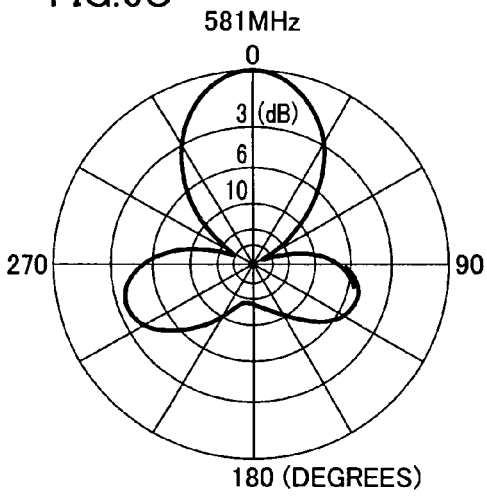
Figure 6D:
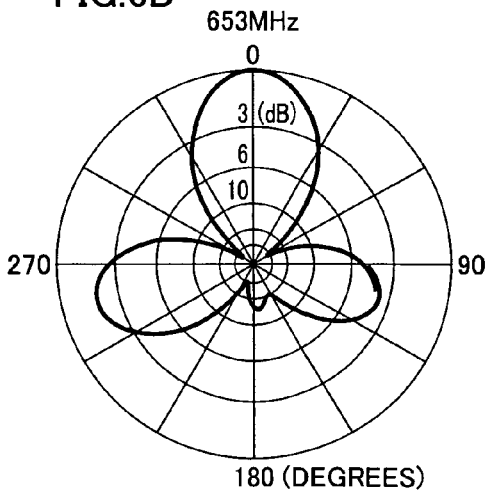
Figure 6E:
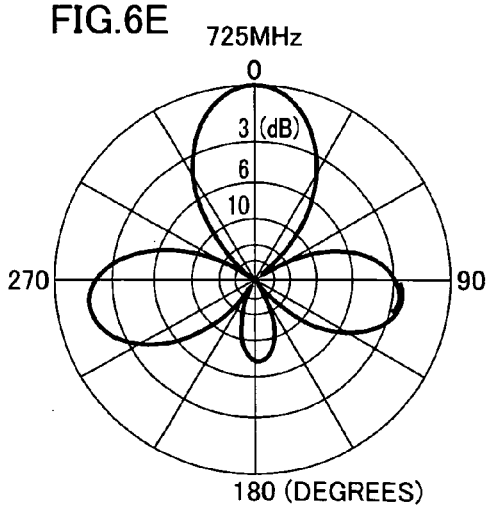
Figure 6F:
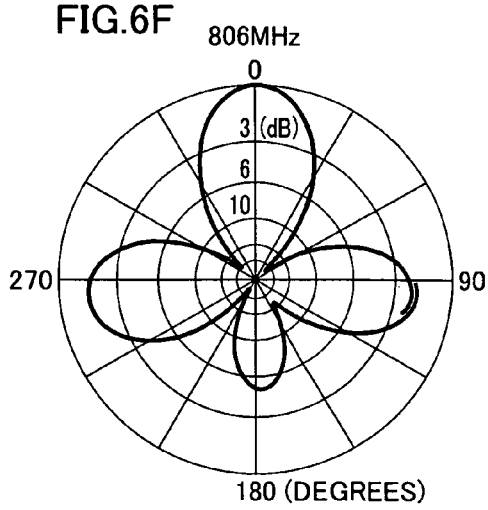

FIG. 4 is a diagram showing the frequency characteristic of gain of this antenna apparatus. As can be understood from FIG. 4, this antenna apparatus has a sufficiently high gain in 470-806 MHz. FIG. 5 is a diagram showing the frequency characteristic of VSWR (Voltage Standing Wave Ratio) of this antenna apparatus. As can be understood from FIG. 5, this antenna apparatus has a sufficiently low VSWR in 470-806 MHz. FIGS. 6A-6F are diagrams showing the frequency characteristic of the unidirectivity in the 0 degree direction of this antenna apparatus. As can be understood from FIGS. 6A-6F, this antenna apparatus has good unidirectivity in 470-806 MHz.

Figure 7:
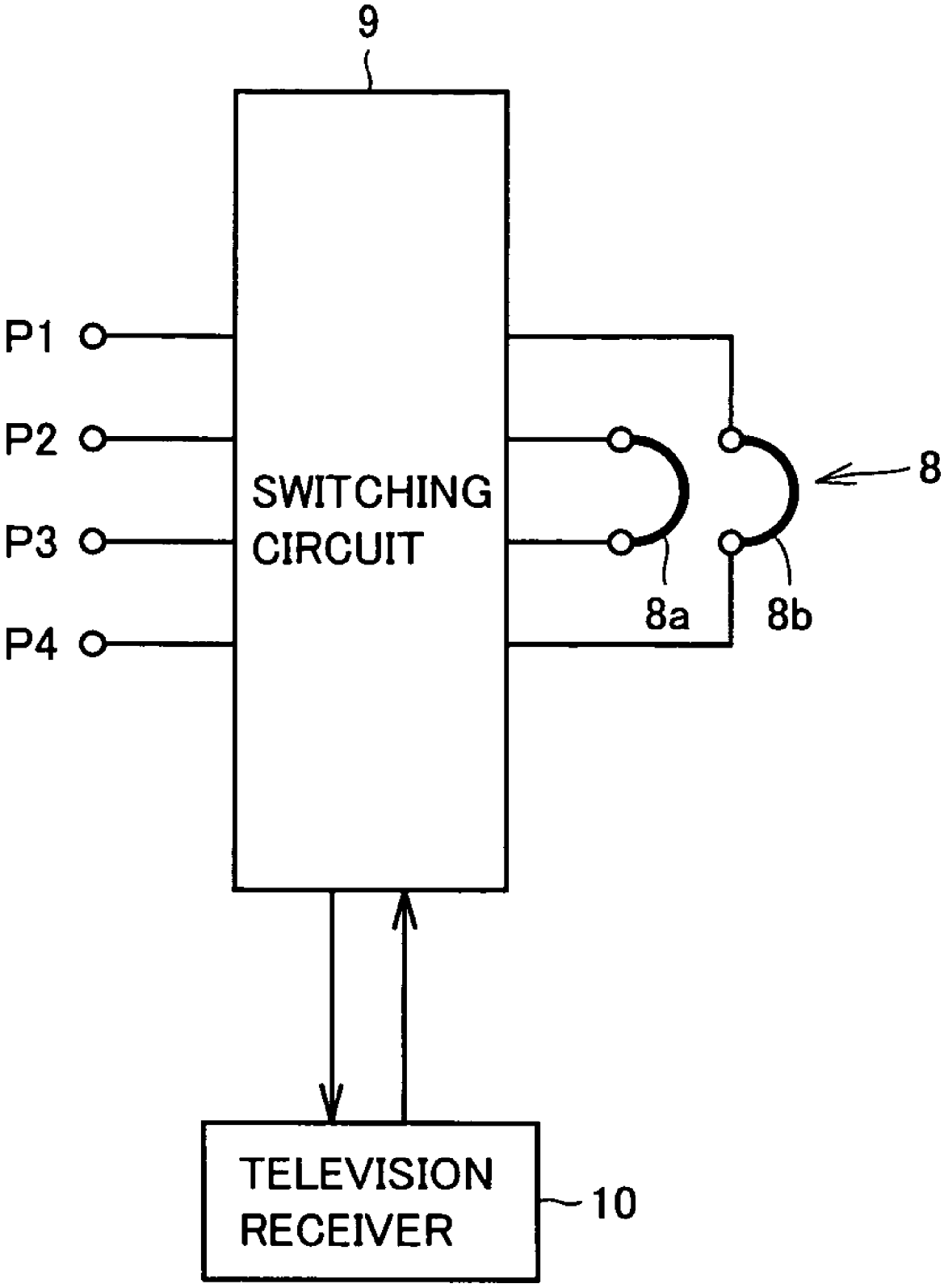
FIG. 7 is a block diagram showing a switching circuit for performing directivity control shown in FIGS. 2A-2D.

FIG. 7 is a diagram illustrating the configuration of this antenna apparatus. In FIG. 7, this antenna apparatus includes a switching circuit 9 in addition to antenna elements 1-4 and phase shifter 8 shown in FIG. 1 and FIGS. 2A-2D. Switching circuit 9 is connected to a television receiver 10. Television receiver 10 applies a control signal corresponding to a UHF television broadcast station selected by a viewer to switching circuit 9. Switching circuit 9 connects feed points P1-P4, phase shifter 8 and television receiver 10 according to a control signal from television receiver 10, as illustrated in FIGS. 2A-2D, controls the directivity of the antenna apparatus in the direction of the selected UHF television broadcast station, and applies the electric wave from the selected UHF television broadcast station to television receiver 10. Television receiver 10 converts the electric wave into an image signal and displays an image on the screen.

In this first embodiment, the unidirectivity can be controlled in four directions of 0 degree, 90 degrees, 180 degrees and 270 degrees and also control the 8-shaped directivity in two directions, namely the 45 degree and 225 degree direction and the 135 degree and 315 degree direction. Therefore, electric waves from a plurality of UHF television broadcast stations can be received with high sensitivity. When an electric wave from 0 degree, 90 degrees, 180 degrees or 270 degrees is received, the reception sensitivity for the electric wave from that direction is higher than the reception sensitivity for the electric wave from the opposite direction, so that multipath interference is less likely.

Figure 8:
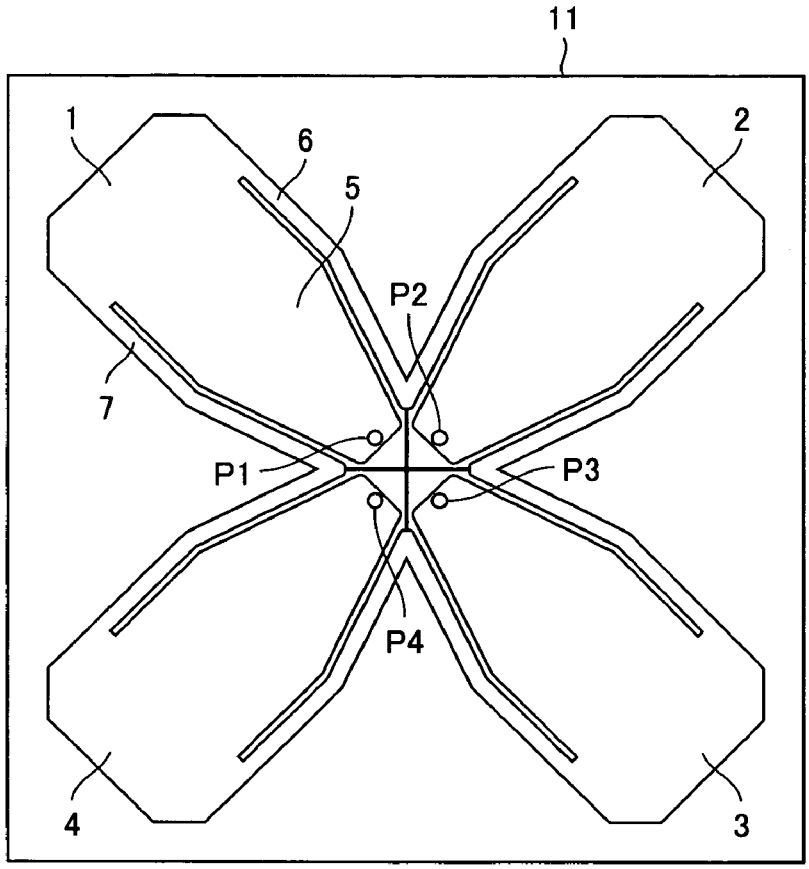
FIG. 8 is a plan view showing a modification to the first embodiment.

Here, antenna elements 1-4 are formed, for example, by stamping a metal plate using a die. Alternatively, as shown in FIG. 8, a metal film on a surface of an insulating substrate (or an insulating film) may be etched in the shape of antenna elements 1-4.

Figure 9:
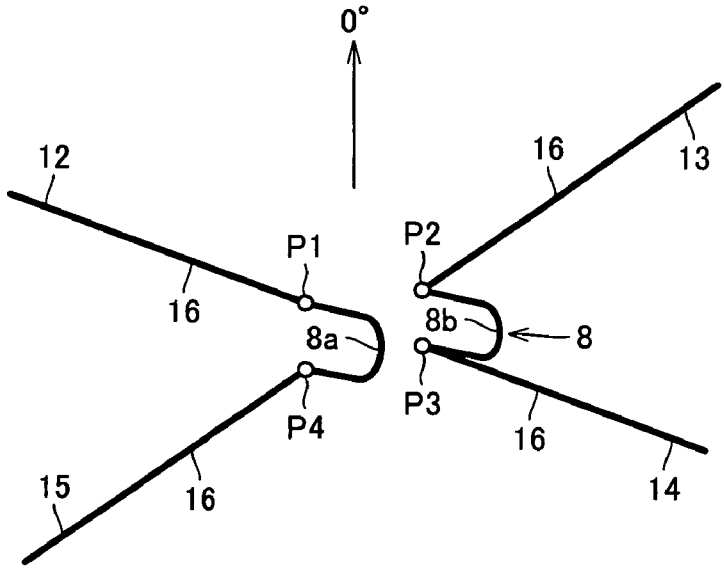
FIG. 9 is a diagram showing another modification to the first embodiment.

FIG. 9 is a diagram showing a modification to the first embodiment. In FIG. 9, this antenna apparatus is configured by replacing antenna elements 1-4 in the first embodiment with antenna elements 12-15. Antenna elements 12-15 respectively have feed points P1-P4. Each of antenna elements 12-15 includes a pole 16 having a prescribed length. Antenna elements 12 and 14, 13 and 15 form the respective half-wavelength dipole antennas. Also in this modification, the same effect as in the first embodiment can be achieved.

Second Embodiment

FIGS. 10A-10D are diagrams showing a directivity control method of an antenna apparatus in accordance with a second embodiment of the present invention, in contrast with FIGS. 2A-2D. In FIGS. 10A-10D, this antenna apparatus differs from the antenna apparatus in the first embodiment in that phase shifter 8 is connected such that the phase of the received electric wave is delayed by 90 degrees and further inversed.

Figure 10A:
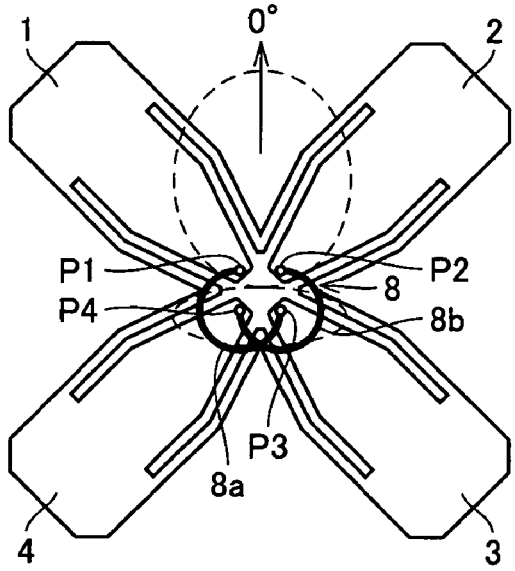
FIGS. 10A-10D are diagrams showing a directivity control method of an antenna apparatus in accordance with a second embodiment of the present invention.

As shown in FIG. 10A, when the unidirectivity of the antenna apparatus is oriented in the 0 degree direction, phase shifter 8 is connected between feed points P1, P2 and feed points P3, P4, and in addition, feed points P1, P2 are connected to the television receiver. An electric wave from the 0 degree direction is received by antenna elements 1, 2 and applied to feed points P1, P2. Furthermore, an electric wave from the 0 degree direction is delayed approximately by 90 degrees in space and then received by antenna elements 4, 3, delayed approximately by 90 degrees and inversed by phase shifter 8, and then transmitted to feed points P1, P2. Therefore, the electric wave received by antenna elements 4, 3 and delayed and inversed by phase shifter 8 and the electric wave received by antenna elements 1, 2 have the same phase and combined at feed points P1, P2.

On the other hand, an electric wave from the 180 degree direction is received by antenna elements 4, 3, delayed approximately by 90 degrees and inversed by phase shifter 8, and then transmitted to feed points P1, P2. Furthermore, an electric wave from the 180 degree direction is delayed approximately by 90 degrees in space and received by antenna elements 1, 2. Therefore, the electric wave received by antenna elements 4, 3 and delayed and inversed by phase shifter 8 and the electric wave received by antenna elements 1, 2 have the opposite phase, and the electric waves attenuate. In this case, the directivity of the antenna apparatus is unidirectional with the reception sensitivity in the 0 degree direction higher than the reception sensitivity in the 180 degree direction, as shown by a dotted line in FIG. 10A.

Furthermore, when the unidirectivity of the antenna apparatus is oriented in the 180 degree direction, similarly to FIG. 10A, phase shifter 8 is connected between feed points P1, P2 and feed points P3, P4, and feed points P3, P4 are connected to the television receiver, in place of feed points P1, P2. In this case, the directivity of the antenna apparatus is opposite to the case in FIG. 10A and is unidirectional with the reception sensitivity of the 180 degree direction higher than the reception sensitivity of the 0 degree direction.

Figure 10B:
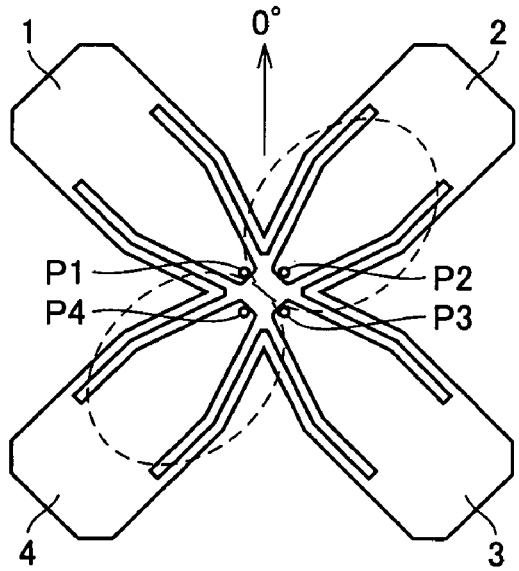

Furthermore, as shown in FIG. 10B, when the 8-shaped directivity of the antenna apparatus is oriented in the 45 degree and 225 degree direction, feed points P1, P3 are connected to the television receiver. An electric wave transmitted from the 45 degree direction is received by antenna elements 1, 3 and applied to the television receiver through feed points P1, P3. Furthermore, an electric wave transmitted from the 225 degree direction is received by antenna elements 1, 3 and applied to the television receiver through feed points P1, P3. In this case, the directivity of the antenna apparatus is 8-shaped directivity in which the reception sensitivity is maximum in the 45 degree direction and the 225 degree direction, as shown by a dotted line in FIG. 10B.

Figure 10C:
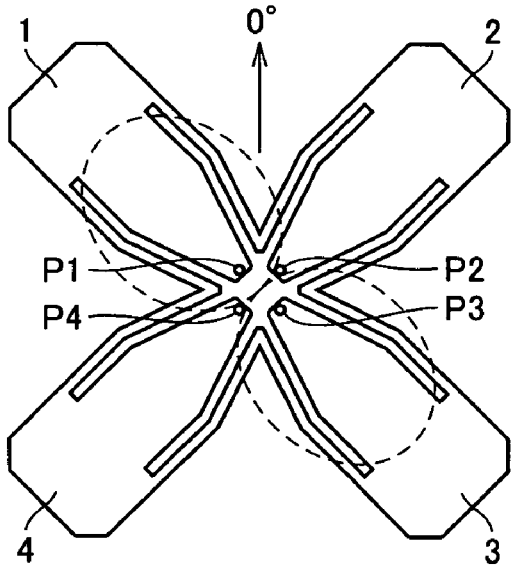

Furthermore, as shown in FIG. 10C, when the 8-shaped directivity of the antenna apparatus is oriented in the 135 degree and 315 degree direction, feed points P2, P4 are connected to the television receiver. An electric wave transmitted from the 135 degree direction is received by antenna elements 2, 4 and applied to the television receiver through feed points P2, P4. Furthermore, an electric wave transmitted from the 315 degree direction is received by antenna elements 2, 4 and applied to the television receiver through feed points P2, P4. In this case, the directivity of the antenna apparatus is 8-shaped directivity in which the reception sensitivity is maximum in the 135 degree direction and the 315 degree direction, as shown by a dotted line in FIG. 10C.

Figure 10D:
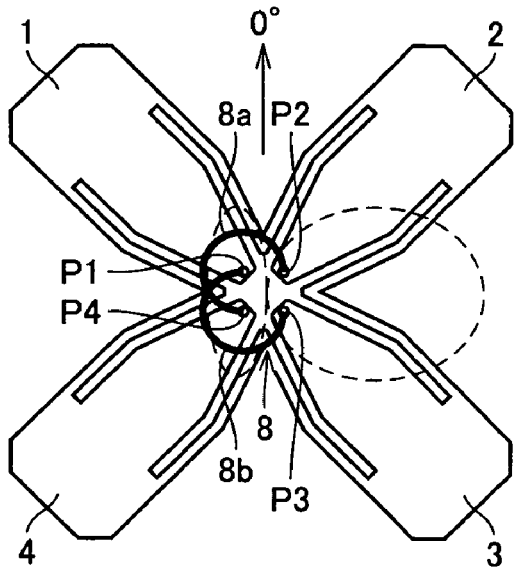

Furthermore, as shown in FIG. 10D, when the unidirectivity of the antenna apparatus is oriented in the 90 degree direction, phase shifter 8 is connected between feed points P2, P3 and feed points P1, P4, and in addition, feed points P2, P3 are connected to the television receiver. An electric wave from the 90 degree direction is received by antenna elements 2, 3 and applied to feed points P2, P3. Furthermore, an electric wave from the 90 degree direction is delayed approximately by 90 degrees in space and then received by antenna elements 1, 4, delayed approximately by 90 degrees and inversed by phase shifter 8, and then transmitted to feed points P2, P3. Therefore, the electric wave received by antenna elements 1, 4 and delayed and inversed by phase shifter 8 and the electric wave received by antenna elements 2, 3 have the same phase and are combined at feed points P2, P3.

On the other hand, an electric wave from the 270 degree direction is received by antenna elements 1, 4, delayed approximately by 90 degrees and inversed by phase shifter 8, and then transmitted to feed points P2, P3. Furthermore, an electric wave from the 270 degree direction is delayed approximately by 90 degrees in space and received by antenna elements 2, 3. Therefore, the electric wave received by antenna elements 1, 4 and delayed and inversed by phase shifter 8 and the electric wave received by antenna elements 2, 3 have the opposite phase, and the electric waves attenuate. In this case, the directivity of the antenna apparatus is unidirectional with the reception sensitivity in the 90 degree direction higher than the reception sensitivity in the 270 degree direction, as shown by a dotted line in FIG. 10D.

Furthermore, when the unidirectivity of the antenna apparatus is oriented in the 270 degree direction, similarly to FIG. 10D, phase shifter 8 is connected between feed points P2, P3 and feed points P4, P1, and feed points P4, P1 are connected to the television receiver, in place of feed points P2, P3. In this case, the directivity of the antenna apparatus is opposite to the case in FIG. 10D and is unidirectional with the reception sensitivity in the 270 degree direction higher than the reception sensitivity in the 90 degree direction.

Figure 11:
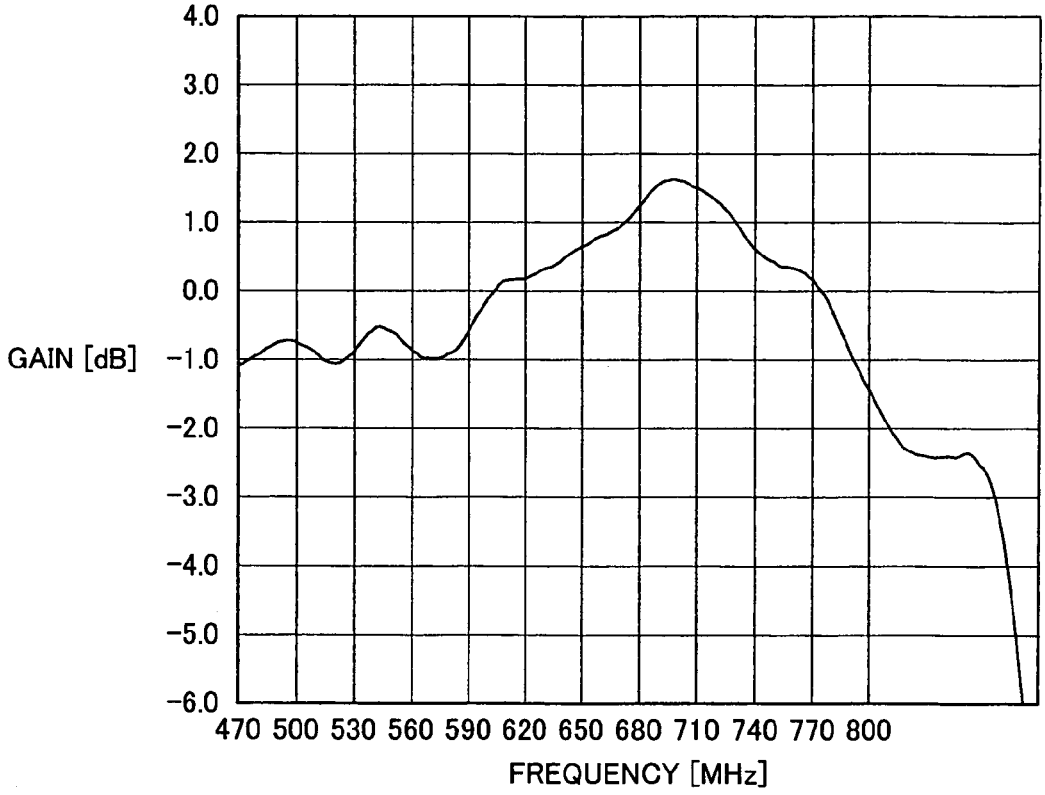
FIG. 11 is a diagram showing a frequency characteristic of gain of the antenna apparatus shown in FIGS. 10A-10D.
Figure 12:
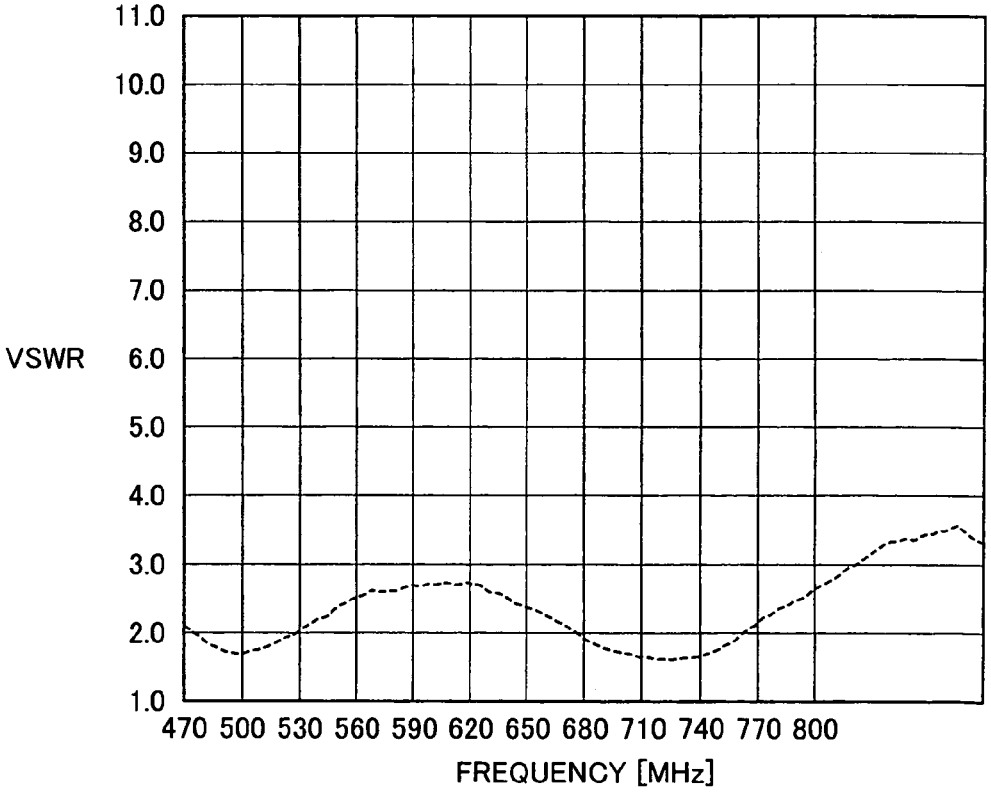
FIG. 12 is a diagram showing a frequency characteristic of VSWR of the antenna apparatus shown in FIGS. 10A-10D.
Figure 13A:
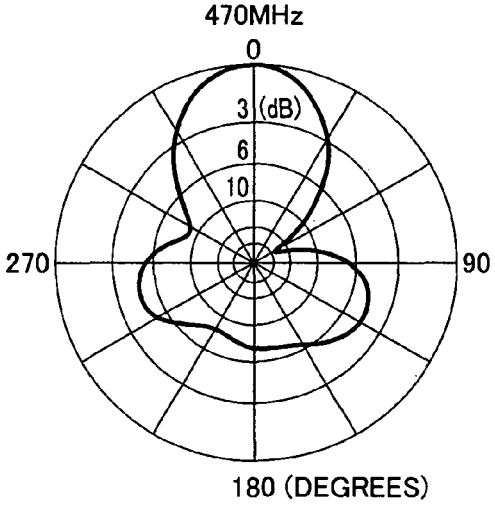
FIGS. 13A-13F are diagrams showing a frequency characteristic of unidirectivity of the antenna apparatus shown in FIGS. 10A-10D.
Figure 13B:
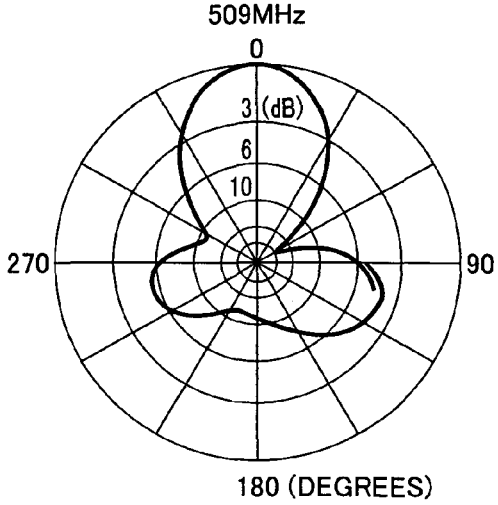
Figure 13C:
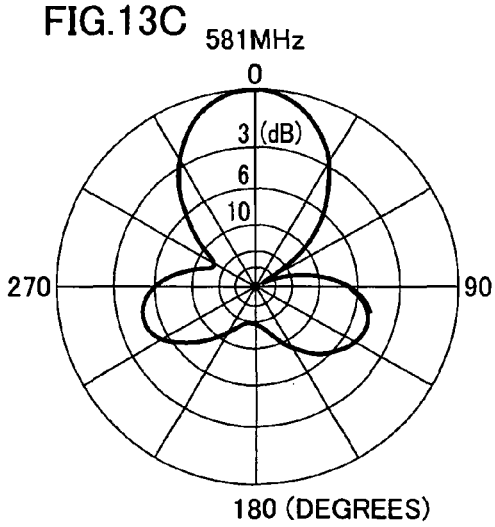
Figure 13D:
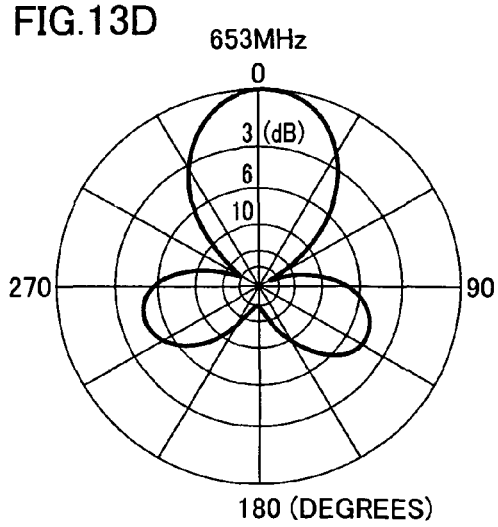
Figure 13E:
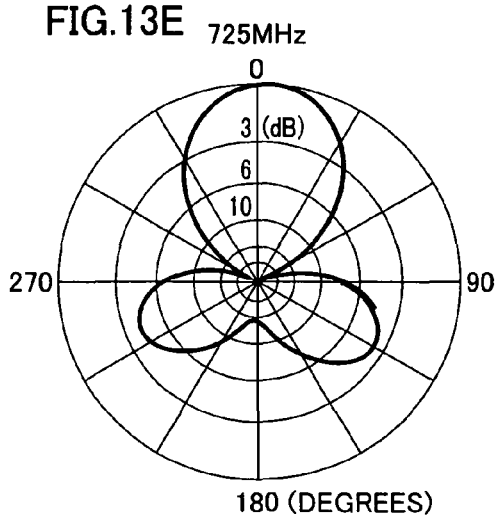
Figure 13F:
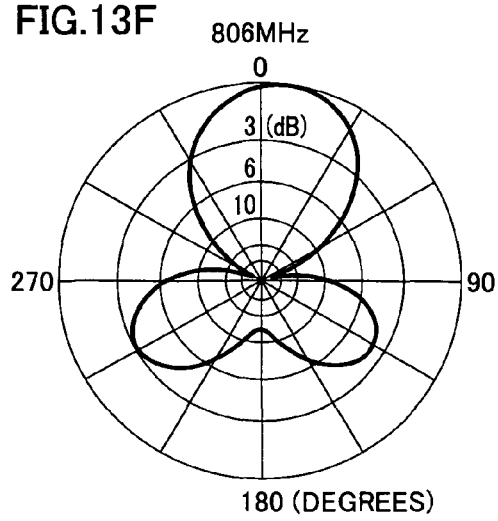

FIG. 11 is a diagram showing the frequency characteristic of gain of this antenna apparatus. As can be understood from FIG. 11, this antenna apparatus has a sufficiently high gain in 470-806 MHz. FIG. 12 is a diagram showing the frequency characteristic of VSWR of this antenna apparatus. As can be understood from FIG. 12, this antenna apparatus has a sufficiently low VSWR in 470-806 MHz. FIGS. 13A-13F are diagrams showing the frequency characteristic of unidirectivity in the 0 degree direction of this antenna apparatus. As can be understood from FIGS. 13A-13F, this antenna apparatus has good unidirectivity in 470-806 MHz.

Also in this second embodiment, the same effect as in the first embodiment can be achieved.

Third Embodiment

Figure 14:
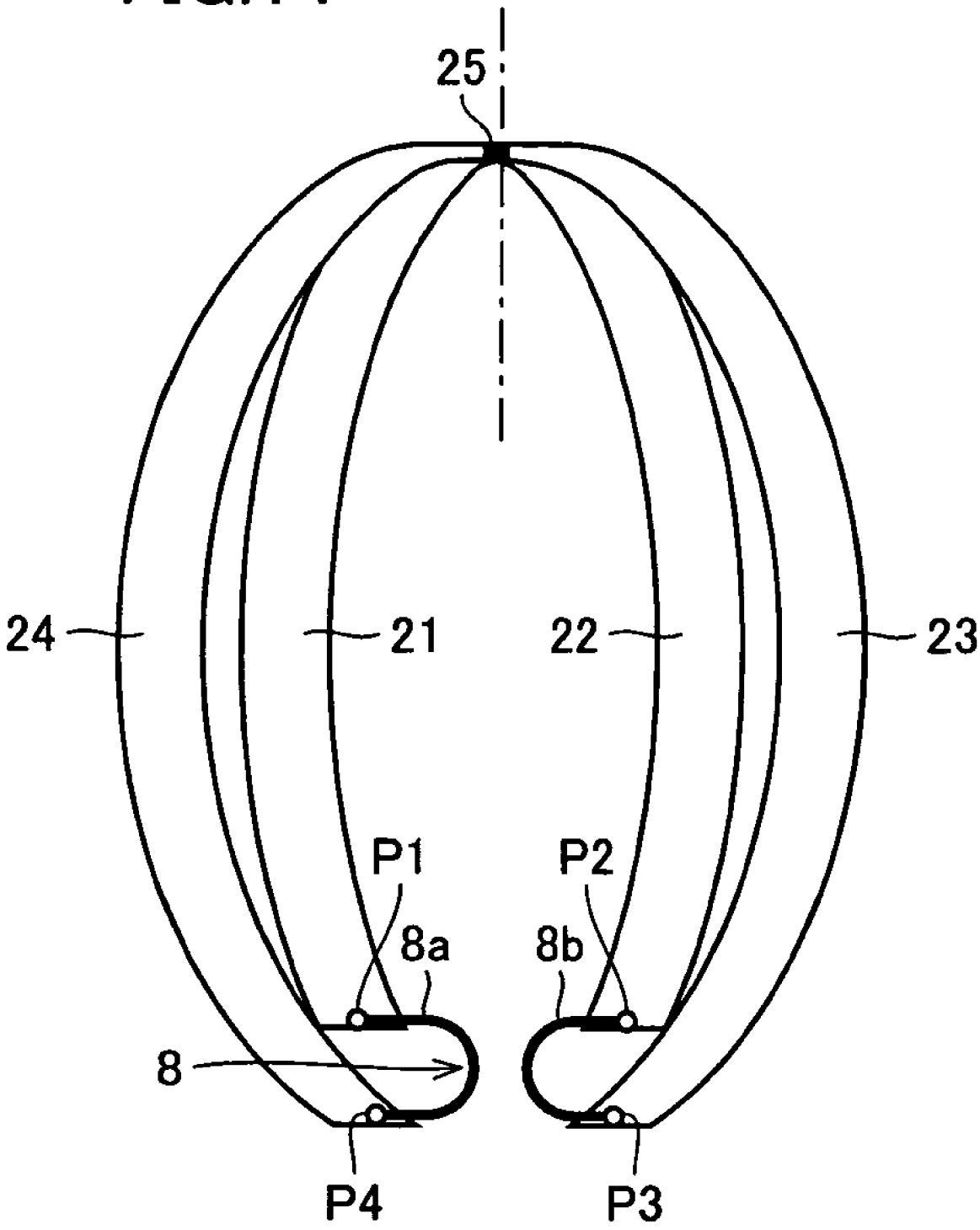
FIG. 14 is a diagram showing a main part of an antenna apparatus in accordance with a third embodiment of the present invention.

FIG. 14 is a diagram showing a main part of an antenna apparatus in accordance with a third embodiment of the present invention, in contrast with FIG. 2A. In FIG. 14, this antenna apparatus differs from the antenna apparatus in the first embodiment in that antenna elements 1-4 are respectively replaced by antenna elements 21-24. Antenna elements 21-24 respectively have feed points P1-P4. Antenna elements 21 and 23 form a first one-wavelength loop antenna, and antenna elements 22 and 24 form a second one-wavelength loop antenna. The central points 25 of first and second one-wavelength loop antennas are connected. Antenna elements 21-24 receive electric waves, similar to antenna elements 1-4. Therefore, similar to the first embodiment, the directivity can be controlled by selectively connecting feed points P1-P4, phase shifter 8 and television receiver 10.

Figure 15:
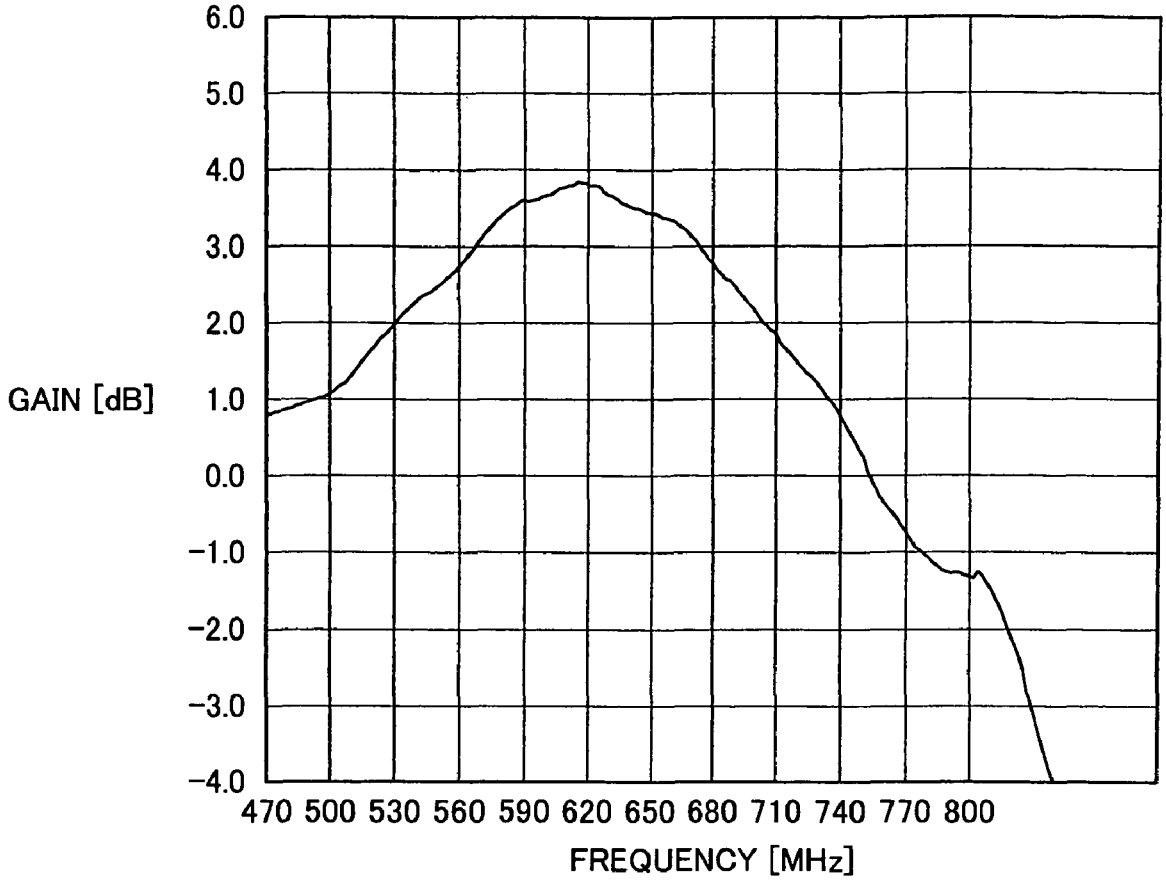
FIG. 15 is a diagram showing a frequency characteristic of gain of the antenna apparatus shown in FIG. 14.
Figure 16A:
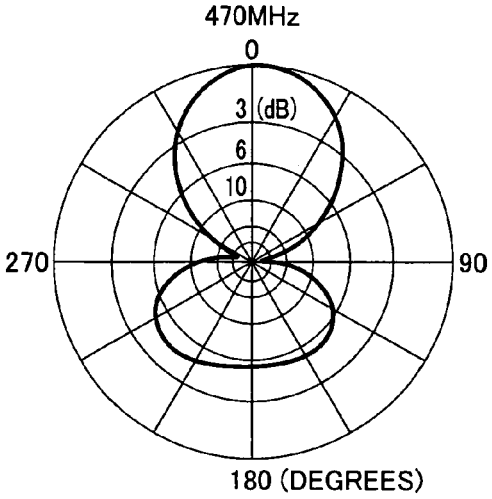
FIGS. 16A-16F are diagrams showing a frequency characteristic of unidirectivity of the antenna apparatus shown in FIG. 14.
Figure 16B:
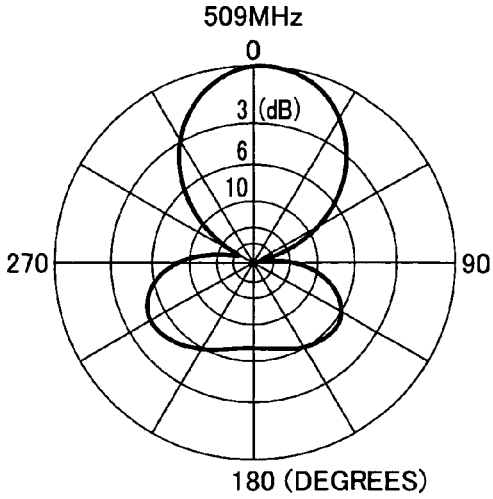
Figure 16C:
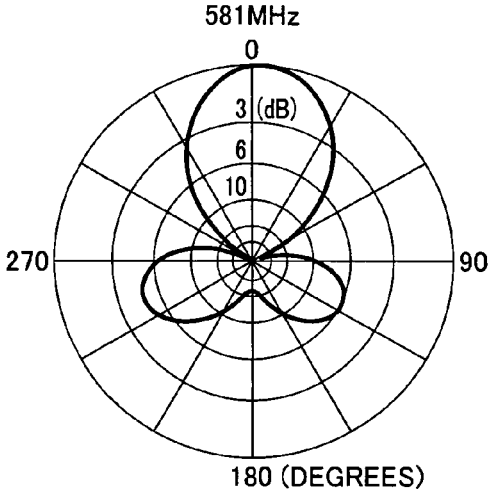
Figure 16D:
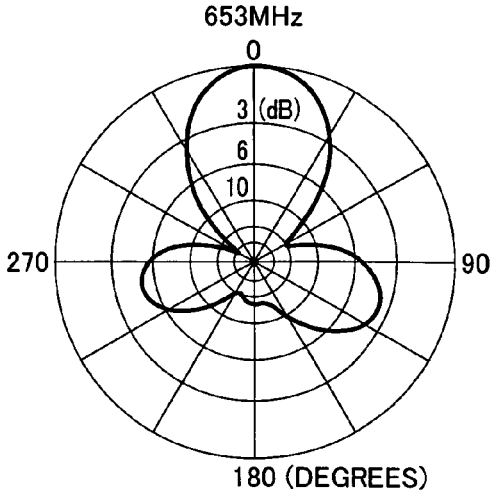
Figure 16E:
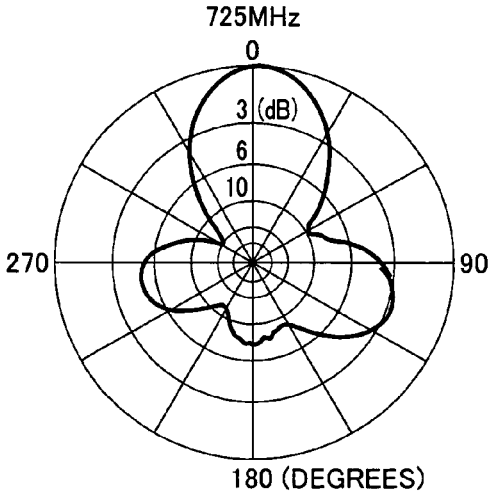
Figure 16F:
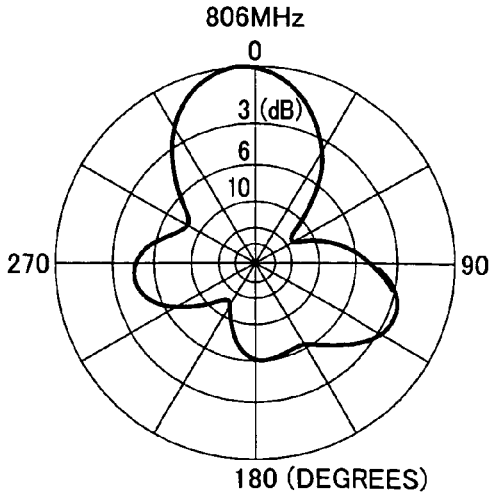

FIG. 15 is a diagram showing the frequency characteristic of gain of this antenna apparatus. As can be understood from FIG. 15, this antenna apparatus has a sufficiently high gain in 470-806 MHz. FIGS. 16A-16F are diagrams showing the frequency characteristic of unidirectivity in the 0 degree direction of this antenna apparatus. As can be understood from FIGS. 16A-16F, this antenna apparatus has good unidirectivity in 470-806 MHz.

Also in this third embodiment, the same effect as in the first embodiment can be achieved.

Figure 17:
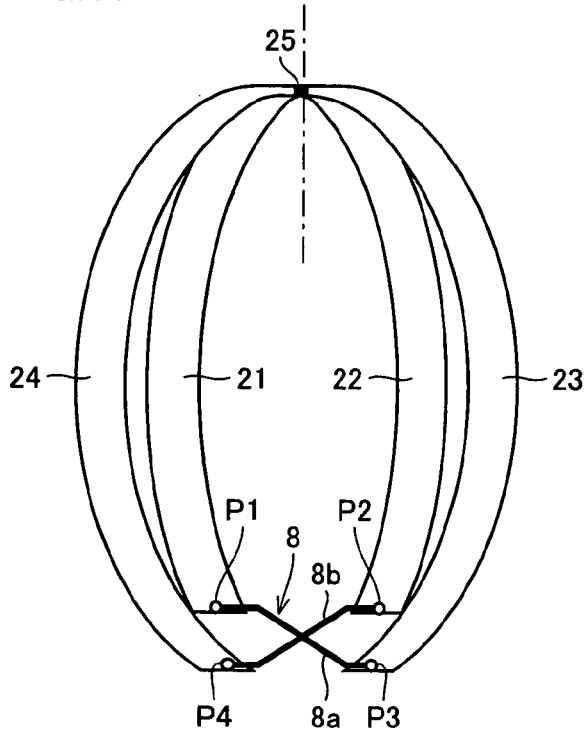
FIG. 17 is a plan view showing a modification to the third embodiment.

FIG. 17 is a diagram showing a modification to the third embodiment of the present invention, in contrast with FIG. 14. In FIG. 17, this antenna apparatus differs from the antenna apparatus in the third embodiment in that phase shifter 8 is connected such that the phase of the received electric wave is delayed by 90 degrees and then inversed. Therefore, similar to the second embodiment, the directivity can be controlled by selectively connecting feed points P1-P4, phase shifter 8 and television receiver 10.

Figure 18:
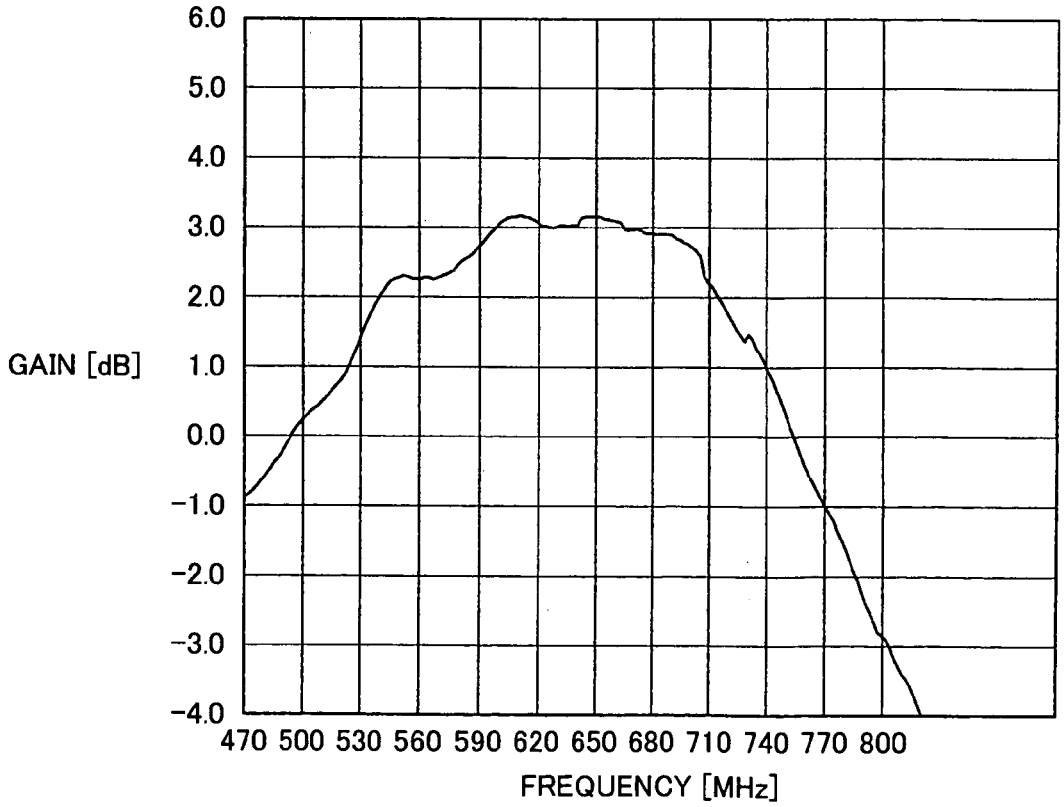
FIG. 18 is a diagram showing a frequency characteristic of gain of the antenna apparatus shown in FIG. 17.
Figure 19A:
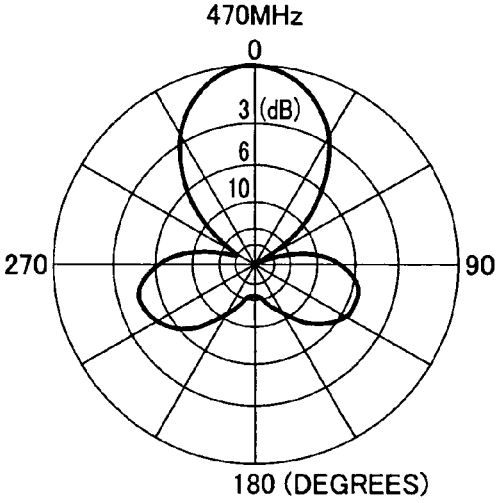
FIGS. 19A-19F are diagrams showing a frequency characteristic of unidirectivity of the antenna apparatus shown in FIG. 17.
Figure 19B:
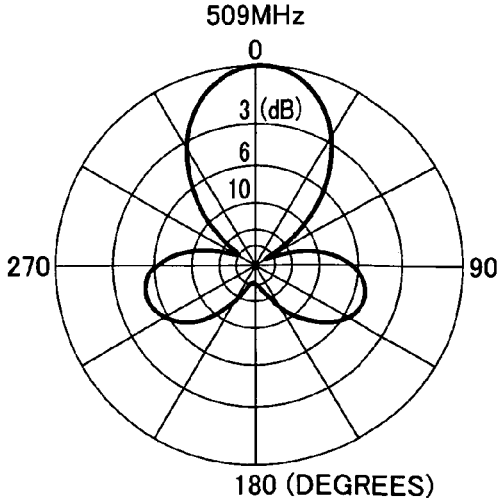
Figure 19C:
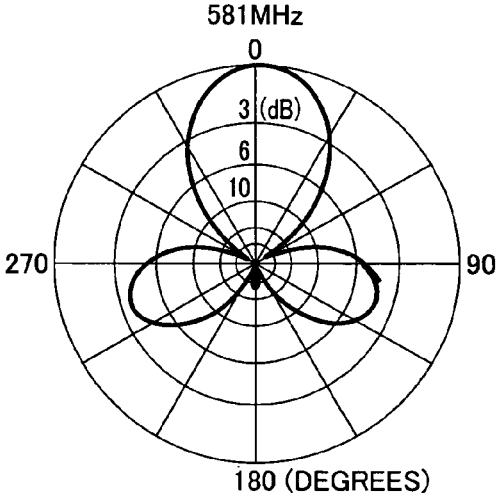
Figure 19D:
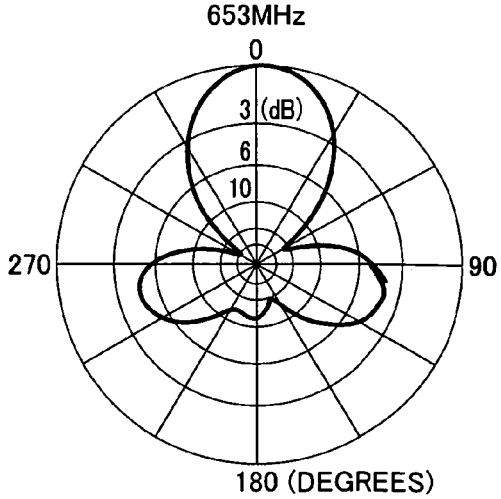
Figure 19E:
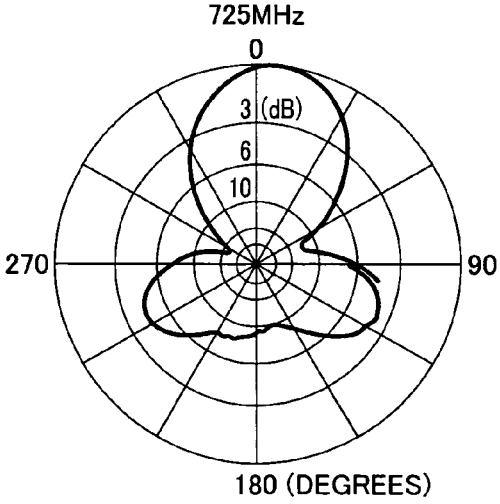
Figure 19F:
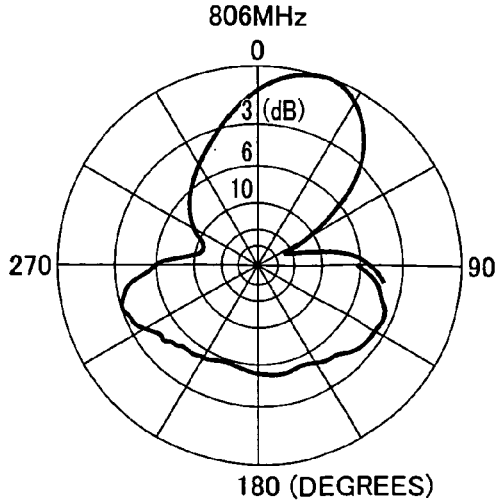

FIG. 18 is a diagram showing the frequency characteristic of gain of the antenna apparatus shown in FIG. 17. As can be understood from FIG. 18, this antenna apparatus has a sufficiently high gain in 470-806 MHz. FIGS. 19A-19F are diagrams showing the frequency characteristic of unidirectivity in the 0 degree direction of this antenna apparatus. As can be understood from FIGS. 19A-19F, this antenna apparatus exhibits good unidirectivity in 470-806 MHz.

Figure 20:
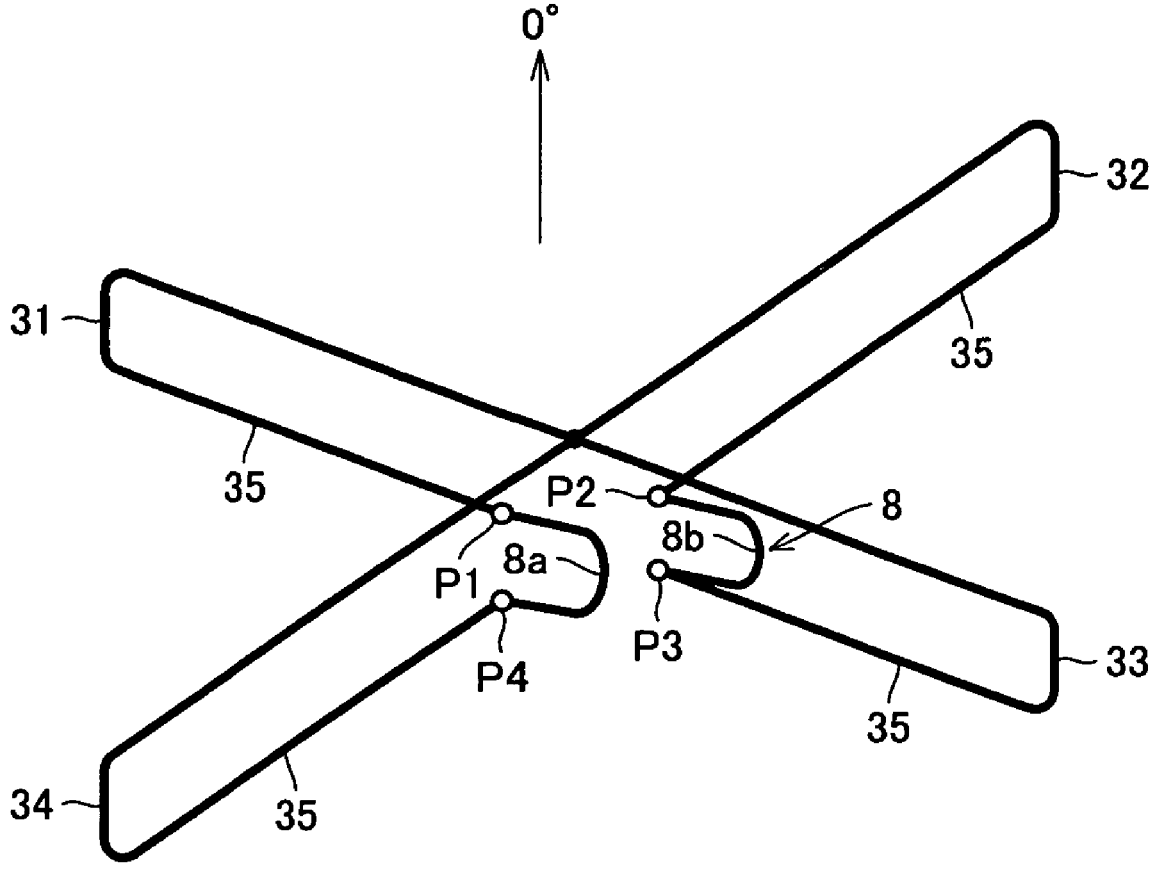
FIG. 20 is a diagram showing another modification to the third embodiment.

FIG. 20 is a diagram showing another modification to this third embodiment. In FIG. 20, this antenna apparatus is formed by replacing antenna elements 21-24 in the third embodiment with antenna elements 31-34. Antenna elements 31-34 respectively have feed points P1-P4. Each of antenna elements 31-34 includes a pole 35 folded in a U-shape with a prescribed length. Feed points P1-P4 are provided at one ends of antenna elements 31-34, and the other ends of antenna elements 31-34 are connected to each other. Antenna elements 31 and 33, 32 and 34 form the respective half-wavelength folded-dipole antennas. Also in this modification, the same effect as in the third embodiment can be achieved.

Fourth Embodiment

Figure 21:
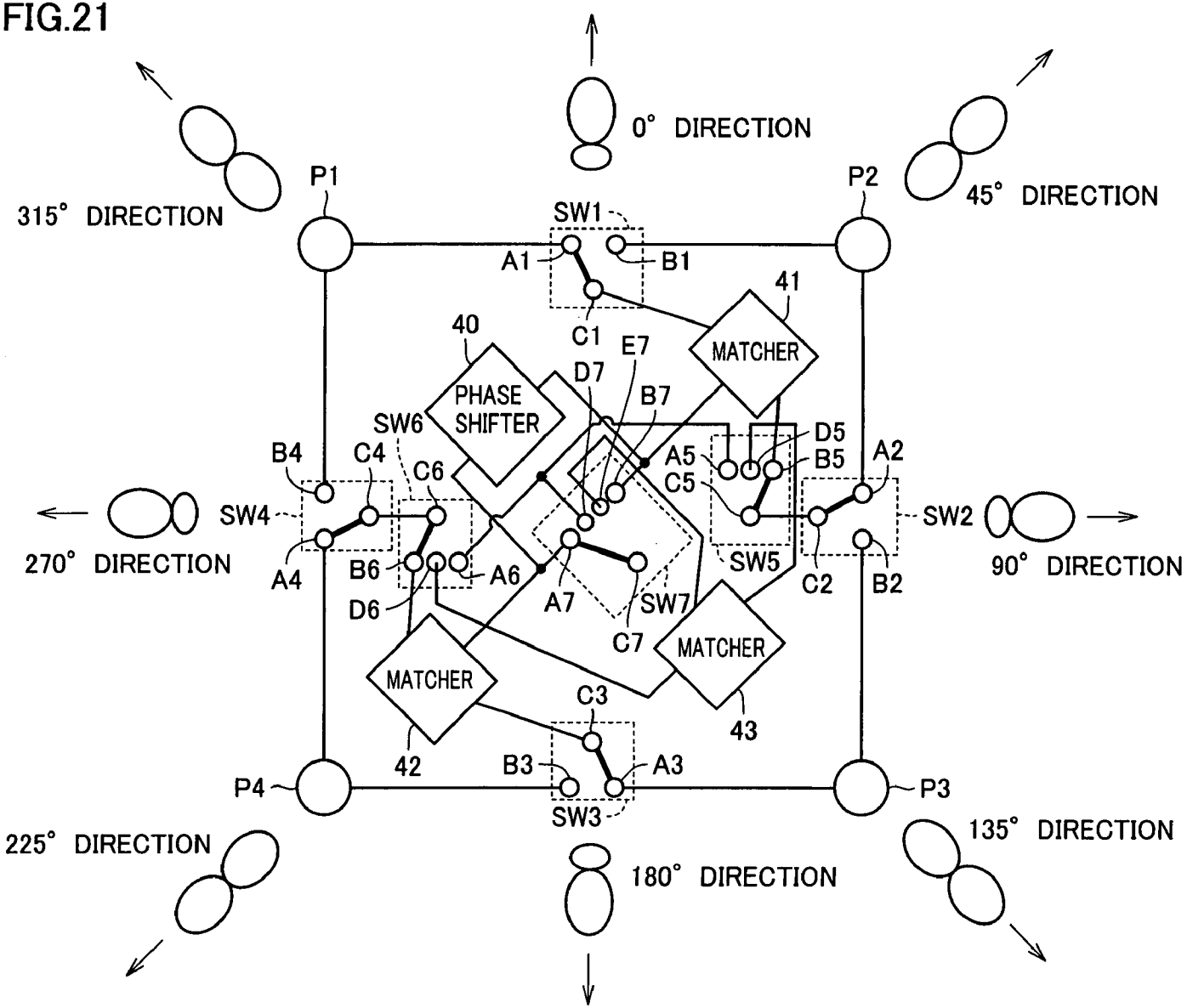
FIG. 21 is a circuit block diagram showing a main part of an antenna apparatus in accordance with a fourth embodiment of the present invention.
Figure 23:
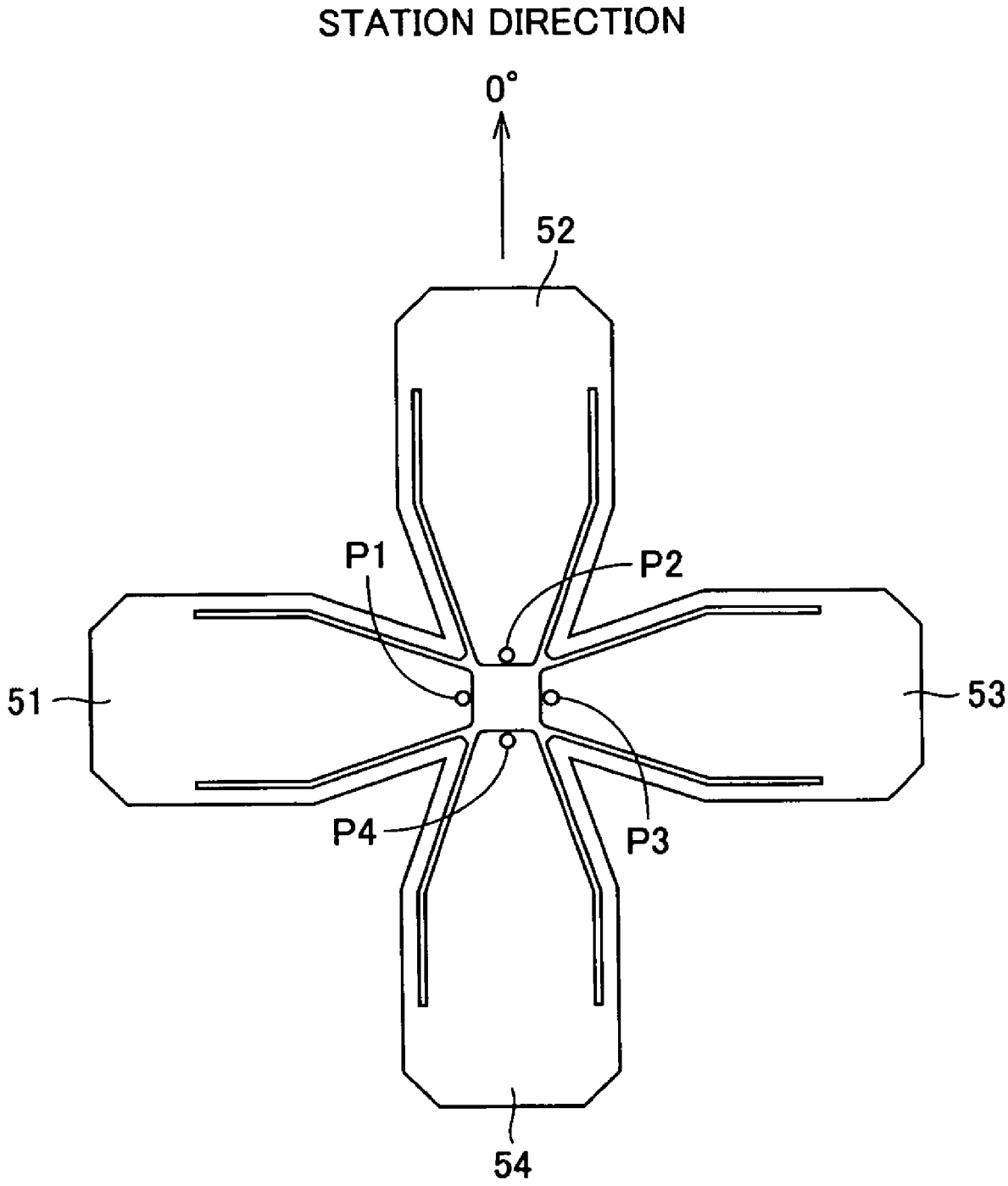
FIG.23 PRIOR ART
FIG. 23 is a plan view showing a main part of a conventional antenna apparatus.
Figure 24A:
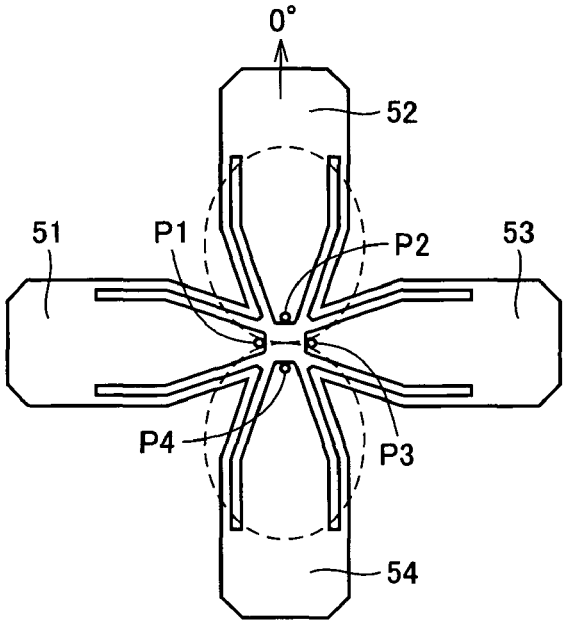
FIG.24A PRIOR ART
FIGS. 24A-24D are diagrams showing a directivity control method of the antenna apparatus shown in FIG. 23.
Figure 24B:
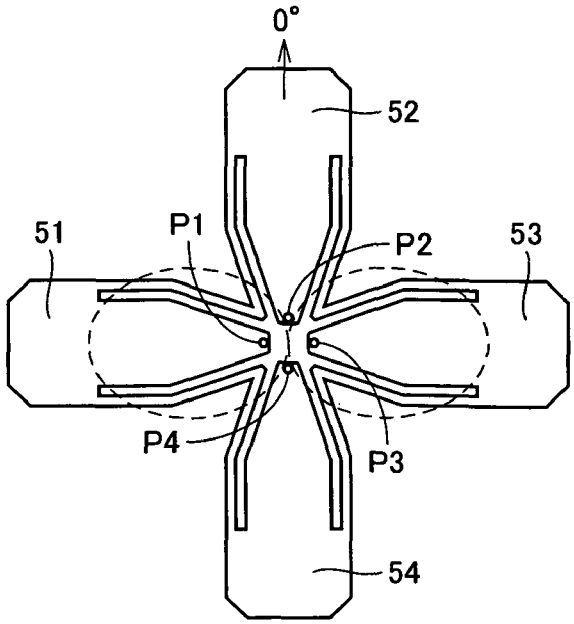
FIG.24B PRIOR ART
Figure 24C:
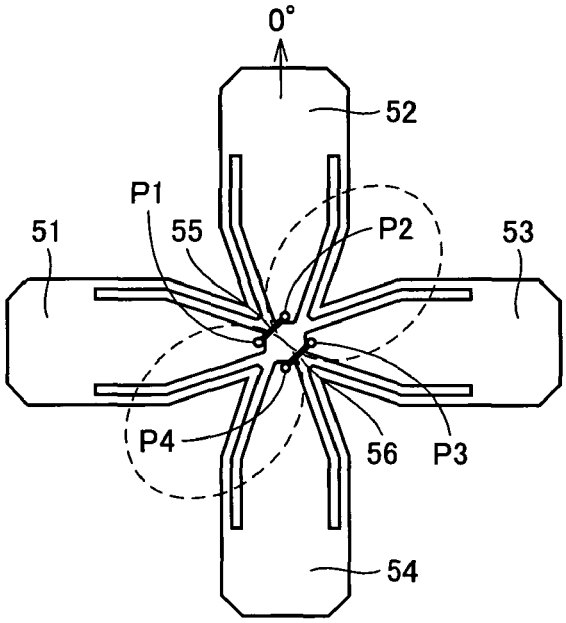
FIG.24C PRIOR ART
Figure 24D:
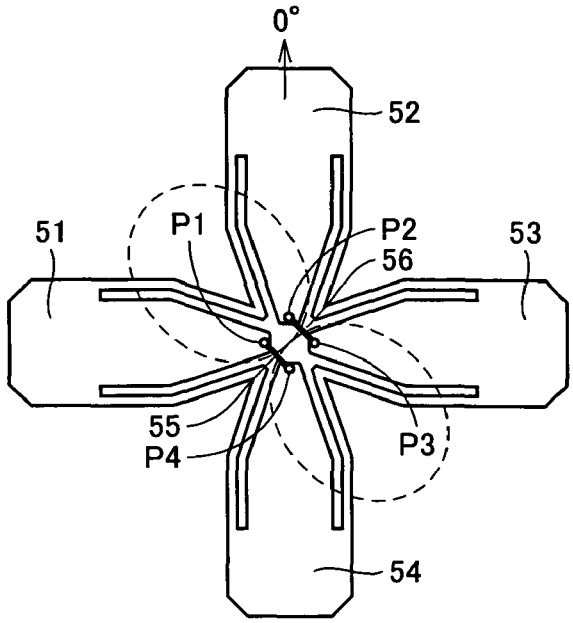
FIG.24D PRIOR ART
Figure 25:
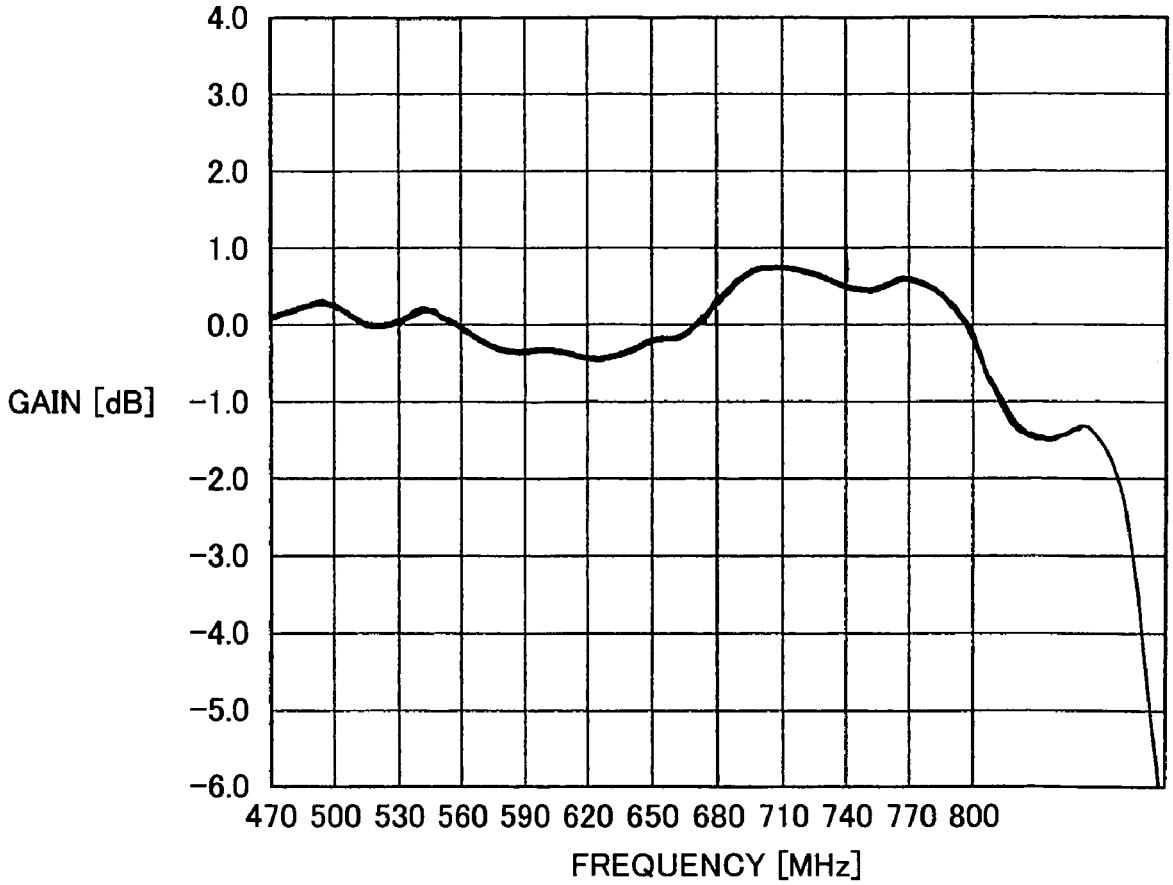
FIG.25 PRIOR ART
FIG. 25 is a diagram showing a frequency characteristic of gain of the antenna apparatus shown in FIG. 23-FIG. 24D.
Figure 26A:
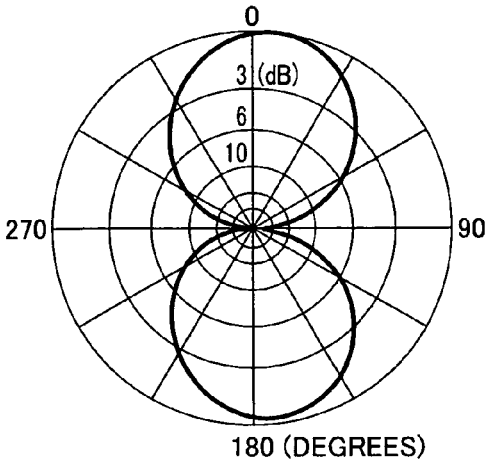
FIG.26A PRIOR ART
FIGS. 26A-26F are diagrams showing a frequency characteristic of 8-shaped directivity of the antenna apparatus shown in FIG. 23-FIG. 24D.
Figure 26B:
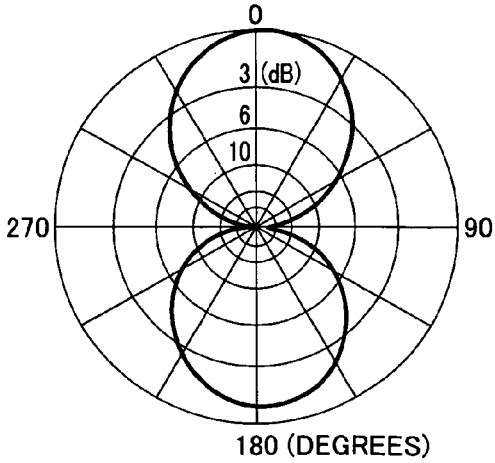
FIG.26B PRIOR ART
Figure 26C:
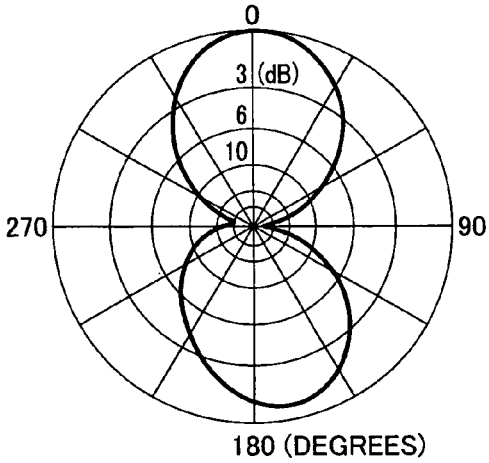
FIG.26C PRIOR ART
Figure 26D:
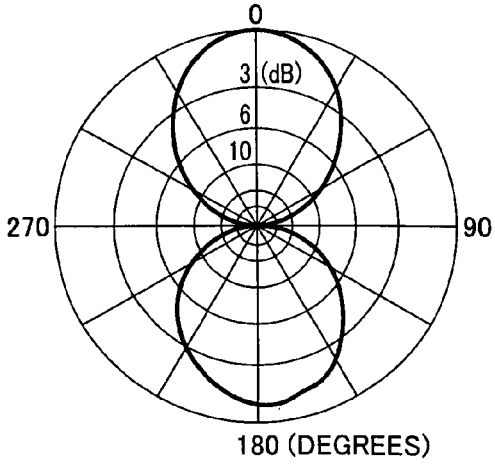
FIG.26D PRIOR ART
Figure 26E:
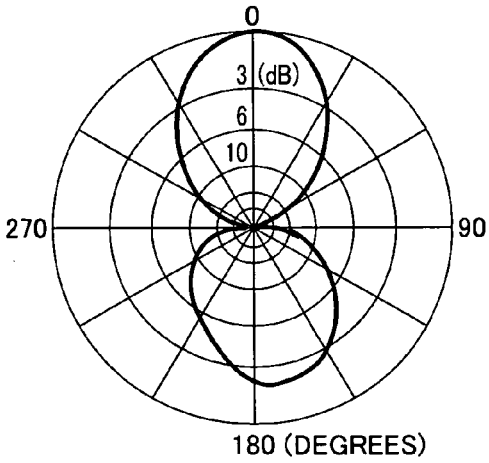
FIG.26E PRIOR ART
Figure 26F:
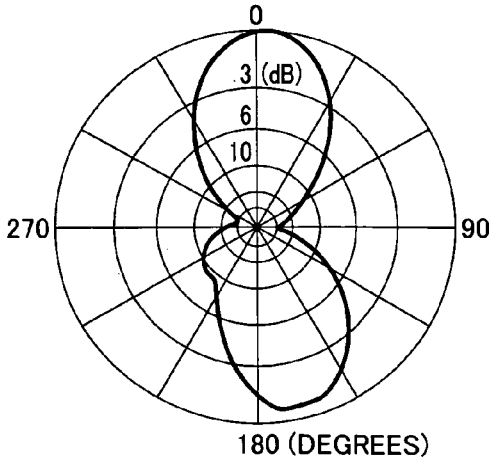
FIG.26F PRIOR ART

FIG. 21 is a circuit block diagram showing a directivity control portion of an antenna apparatus in accordance with a fourth embodiment of the present invention. This antenna apparatus includes antenna elements 1-4 in FIG. 1 and a directivity control portion in FIG. 21. The directivity control portion includes a phase shifter 40, matchers 41-43 and switches SW1-SW7. Phase shifter 40 is formed, for example, of a coaxial line with a length of 100 mm and with the characteristic impedance of 75 ohms to delay the phase of the received electric wave approximately by 90 degrees. Each of matchers 41-43 suppresses reflection of the received electric wave for transmission to television receiver 10.

Switch SW1 has a switching terminal A1 connected to feed point P1, a switching terminal B1 connected to feed point P2, and a common terminal C1 connected to a first input terminal of matcher 41. Switch SW2 has a switching terminal A2 connected to feed point P2, a switching terminal B2 connected to feed point P3, and a common terminal C2 connected to a common terminal C5 of switch SW5. Switch SW3 has a switching terminal A3 connected to feed point P3, a switching terminal B3 connected to feed point P4, and a common terminal C3 connected to a first input terminal of matcher 42. Switch SW4 has a switching terminal A4 connected to feed point P4, a switching terminal B4 connected to feed point P1, and a common terminal C4 connected to a common terminal C6 of switch SW6.

Switch SW5 has a switching terminal A5 connected to a switching terminal A6 of switch SW6 and a switching terminal D7 of switch SW7, a switching terminal B5 connected to a second input terminal of matcher 41, a switching terminal D5 connected to a first input terminal of matcher 43, and a common terminal C5 connected to common terminal C2 of switch SW2.

Switch SW6 has a switching terminal A6 connected to the aforementioned switching terminals A5, D7, a switching terminal B6 connected to a second input terminal of matcher 42, a switching terminal D6 connected to a second input terminal of matcher 43, and a common terminal C6 connected to the aforementioned common terminal C4.

Switch SW7 has a switching terminal A7 connected to an output terminal of matcher 42, a switching terminal B7 connected to an output terminal of matcher 41, a switching terminal D7 connected to the aforementioned switching terminals A5, A6, a switching terminal E7 connected to an output terminal of matcher 43, and a common terminal C7 connected to the television receiver through a coaxial line. Switches SW1-SW7 are controlled, for example, by a control signal from the television receiver. Phase shifter 40 is connected between the output terminals of matchers 41, 42.

FIG. 22 is a diagram showing the relation between the conduction terminals of switches SW1-SW7 and the directivity of the antenna apparatus. In FIG. 22, when the unidirectivity in the 0 degree direction is desired to be realized, conduction is established between terminals A1 and C1 of switch SW1, between terminals A2 and C2 of switch SW2, between terminals A3 and C3 of switch SW3, between terminals A4 and C4 of switch SW4, between terminals B5 and C5 of switch SW5, between terminals B6 and C6 of switch SW6, and between terminals A7 and C7 of switch SW7. Accordingly, feed points P1, P2 are connected to one terminal of phase shifter 40 through matcher 41, feed points P4, P3 are connected to the other terminal of phase shifter 40 through matcher 42, and the other terminal of phase shifter 40 is connected to the television receiver through common terminal C7 of switch SW7. This is equivalent to the state in FIG. 2A. Therefore, the unidirectivity in the 0 degree direction is obtained.

Furthermore, when the unidirectivity in the 180 degree direction is desired to be realized, switches SW1-SW6 are brought into the same state as in the case where the unidirectivity in the 0 degree direction is realized, and conduction is established between terminals B7 and C7 of switch SW7. This is equivalent to the state in which phase shifter 8 is connected as in FIG. 2A and feed points P1, P2 are connected to the television receiver. Therefore, the unidirectivity in the 180 degree direction is obtained.

Furthermore, when the 8-shaped directivity in the 45 degree and 225 degree direction is desired to be realized, conduction is established between terminals B1 and C1 of switch SW1, between terminals B2 and C2 of switch SW2, between terminals B3 and C3 of switch SW3, between terminals B4 and C4 of switch SW4, between terminals D5 and C5 of switch SW5, between terminals D6 and C6 of switch SW6, and between terminals E7 and C7 of switch SW7. Accordingly, feed point P1 is connected to the second input terminal of matcher 43, feed point P3 is connected to the first input terminal of matcher 43, and the output terminal of matcher 43 is connected to the television receiver through common terminal C7 of switch SW7. This is equivalent to the state in FIG. 2B. Therefore, the 8-shaped directivity in the 45 degree and 225 degree direction is obtained.

Furthermore, when the unidirectivity in the 90 degree direction is desired to be realized, conduction is established between terminals B1 and C1 of switch SW1, between terminals B2 and C2 of switch SW2, between terminals B3 and C3 of switch SW3, between terminals B4 and C4 of switch SW4, between terminals B5 and C5 of switch SW5, between terminals B6 and C6 of switch SW6, and between terminals A7 and C7 of switch SW7. Accordingly, feed points P2, P3 are connected to one terminal of phase shifter 40 through matcher 41, and feed points P1, P4 are connected to the other terminal of phase shifter 40 through matcher 42, and the other terminal of phase shifter 40 is connected to the television receiver through common terminal C7 of switch SW7. This is equivalent to the state in FIG. 2D. Therefore, the unidirectivity in the 90 degree direction is obtained.

Furthermore, when the unidirectivity in the 270 degree direction is desired to be realized, switches SW1-SW6 are brought into the same state as in the case where the unidirectivity in the 90 degree direction is realized, and conduction is established between terminals B7 and C7 of switch SW7. This is equivalent to the state in which phase shifter 8 is connected as in FIG. 2D and feed points P2, P3 are connected to the television receiver. Therefore, the unidirectivity in the 270 degree direction is obtained.

Furthermore, when the 8-shaped directivity in the 135 degree and 315 degree direction is desired to be realized, conduction is established between terminals A1 and C1 of switch SW1, between terminals A2 and C2 of switch SW2, between terminals A3 and C3 of switch SW3, between terminals A4 and C4 of switch SW4, between terminals D5 and C5 of switch SW5, between terminals D6 and C6 of switch SW6, and between terminals E7 and C7 of switch SW7. Accordingly, feed point P2 is connected to the first input terminal of matcher 43, feed point P4 is connected to the second input terminal of matcher 43, and the output terminal of matcher 43 is connected to the television receiver through common terminal C7 of switch SW7. This is equivalent to the state in FIG. 2C. Therefore, the 8-shaped directivity in the 135 degree and 315 degree direction is obtained.

Also in this fourth embodiment, the same effect as in the first embodiment is achieved.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An antenna apparatus capable of directivity control comprising:

first to fourth antenna elements successively arranged at regular angular intervals around a central point on a same plane and respectively having first to fourth feed points, wherein said first and third antenna elements form a first dipole antenna having 8-shaped directivity in directions of said second and fourth antenna elements, said second and fourth antenna elements form a second dipole antenna having 8-shaped directivity in directions of said first and third antenna elements, an electric wave from a first direction between said first and second antenna elements is received by said first and second antenna elements, and is delayed approximately by 90 degrees in space to be received by said fourth and third antenna elements, an electric wave from a second direction between said second and third antenna elements is received by said second and third antenna elements, and is delayed approximately by 90 degrees in space to be received by said first and fourth antenna elements, an electric wave from a third direction between said third and fourth antenna elements is received by said third and fourth antenna elements, and is delayed approximately by 90 degrees in space to be received by said second and first antenna elements, and an electric wave from a fourth direction between said fourth and first antenna elements is received by said fourth and first antenna elements, and is delayed approximately by 90 degrees in space to be received by said third and second antenna elements, said antenna apparatus further comprising:

a phase shifter delaying a phase of a received electric wave approximately by 90 degrees; and first switching circuit controlling a direction of unidirectivity of said antenna apparatus, wherein said first switching circuit connects said phase shifter between said first and second feed points and said fourth and third feed points, and combines an electric wave received by said first and second antenna elements and delayed by said phase shifter with an electric wave received by said fourth and third antenna elements for application to a receiver apparatus, in a first case in which said unidirectivity is controlled in said first direction, connects said phase shifter between said second and third feed points and said first and fourth feed points, and combines an electric wave received by said second and third antenna elements and delayed by said phase shifter with an electric wave received by said first and fourth antenna elements for application to said receiver apparatus, in a second case in which said unidirectivity is controlled in said second direction, connects said phase shifter between said third and fourth feed points and said second and first feed points, and combines an electric wave received by said third and fourth antenna elements and delayed by said phase shifter with an electric wave received by said second and first antenna elements for application to said receiver apparatus, in a third case in which said unidirectivity is controlled in said third direction, and connects said phase shifter between said fourth and first feed points and said third and second feed points, and combines an electric wave received by said fourth and first antenna elements and delayed by said phase shifter with an electric wave received by said third and second antenna elements for application to said receiver apparatus, in a fourth case in which said unidirectivity is controlled in said fourth direction.

2. The antenna apparatus according to claim 1, further comprising second switching circuit controlling a direction of 8-shaped directivity of said antenna apparatus, wherein said second switching circuit applies an electric wave received by said second and fourth antenna elements to said receiver apparatus, in a fifth case in which said 8-shaped directivity is controlled in directions of said first and third antenna elements, and applies an electric wave received by said first and third antenna elements to said receiver apparatus, in a sixth case in which said 8-shaped directivity is controlled in directions of said second and fourth antenna elements.

3. An antenna apparatus capable of directivity control comprising:

first to fourth antenna elements successively arranged at regular angular intervals around a central point on a same plane and respectively having first to fourth feed points, wherein said first and third antenna elements form a first dipole antenna having 8-shaped directivity in directions of said second and fourth antenna elements, said second and fourth antenna elements form a second dipole antenna having 8-shaped directivity in directions of said first and third antenna elements, an electric wave from a first direction between said first and second antenna elements is received by said first and second antenna elements, and is delayed approximately by 90 degrees in space to be received by said fourth and third antenna elements, an electric wave from a second direction between said second and third antenna elements is received by said second and third antenna elements, and is delayed approximately by 90 degrees in space to be received by said first and fourth antenna elements, an electric wave from a third direction between said third and fourth antenna elements is received by said third and fourth antenna elements, and is delayed approximately by 90 degrees in space to be received by said second and first antenna elements, and an electric wave from a fourth direction between said fourth and first antenna elements is received by said fourth and first antenna elements, and is delayed approximately by 90 degrees in space to be received by said third and second antenna elements, said antenna apparatus further comprising:

a phase shifter delaying a phase of a received electric wave approximately by 90 degrees; and a first switching circuit controlling a direction of unidirectivity of said antenna apparatus, wherein said first switching circuit connects said phase shifter between said first and second feed points and said third and fourth feed points, and combines an electric wave received by said first and second antenna elements with an electric wave received by said third and fourth antenna elements and delayed by said phase shifter for application to a receiver apparatus, in a first case in which said unidirectivity is controlled in said first direction, connects said phase shifter between said second and third feed points and said fourth and first feed points, and combines an electric wave received by said second and third antenna elements with an electric wave received by said fourth and first antenna elements and delayed by said phase shifter for application to said receiver apparatus, in a second case in which said unidirectivity is controlled in said second direction, connects said phase shifter between said third and fourth feed points and said first and second feed points, and combines an electric wave received by said third and fourth antenna elements with an electric wave received by said first and second antenna elements and delayed by said phase shifter for application to said receiver apparatus, in a third case in which said unidirectivity is controlled in said third direction, and connects said phase shifter between said fourth and first feed points and said second and third feed points, and combines an electric wave received by said fourth and first antenna elements with an electric wave received by said second and third antenna elements and delayed by said phase shifter for application to said receiver apparatus, in a fourth case in which said unidirectivity is controlled in said fourth direction.

4. The antenna apparatus according to claim 3, further comprising second switching circuit controlling a direction of 8-shaped directivity of said antenna apparatus, wherein said second switching circuit applies an electric wave received by said second and fourth antenna elements to said receiver apparatus, in a fifth case in which said 8-shaped directivity is controlled in directions of said first and third antenna elements, and applies an electric wave received by said first and third antenna elements to said receiver apparatus, in a sixth case in which said 8-shaped directivity is controlled in directions of said second and fourth antenna elements.

5. The antenna apparatus according to claim 1, wherein each of said first and second dipole antennas is a fan dipole antenna.

6. The antenna apparatus according to claim 1, wherein said first and second dipole antennas are formed of a conductive film provided on an insulating substrate or an insulating film.

7. The antenna apparatus according to claim 3, wherein each of said first and second dipole antennas is a fan dipole antenna.

8. The antenna apparatus according to claim 3, wherein said first and second dipole antennas are formed of a conductive film provided on an insulating substrate or an insulating film.

* * * * *